United States Patent [19]

Tanaka et al.

[11] Patent Number: 4,824,491

[45] **Date of Patent: * Apr. 25, 1989**

[54] PROCESS FOR THE PRODUCTION OF A STRIP OF A CHROMIUM STAINLESS STEEL OF A DUPLEX STRUCTURE HAVING HIGH STRENGTH AND ELONGATION AS WELL AS REDUCED PLANE ANISOTROPY

[75] Inventors: Teruo Tanaka; Katsuhisa Miyakusu; Hiroshi Fujimoto, all of Yamaguchi, Japan

[73] Assignee: Nisshin Steel Co., Ltd., Tokyo, Japan

[ * ] Notice: The portion of the term of this patent subsequent to Mar. 14, 2006 has been disclaimed.

[21] Appl. No.: 134,873

[22] Filed: Dec. 18, 1987

[30] Foreign Application Priority Data

Dec. 30, 1986 [JP] Japan ..... 61-311961
Dec. 30, 1986 [JP] Japan ..... 61-311962
Jan. 3, 1987 [JP] Japan ..... 62-101

[51] Int. Cl.[4] ..... C21D 8/02
[52] U.S. Cl. ..... 148/12 EA; 148/12 E
[58] Field of Search ..... 148/12 EA, 12 E, 325, 148/12 C

[56] References Cited

U.S. PATENT DOCUMENTS 3,650,848 3/1972 Schneider et al. ..... 148/12 EA

FOREIGN PATENT DOCUMENTS 2023657 1/1980 United Kingdom ..... 148/325

*Primary Examiner*—Deborah Yee
*Attorney, Agent, or Firm*—Wenderoth, Lind & Ponack

[57] ABSTRACT

Process for producing steel strip of duplex structure wherein cold rolled strip of chromium stainless steel comprising, in addition to Fe, 10.0% to 20.0% of Cr, to 0.10% C, to 0.12% of N, the (C+N) being 0.01% to 0.20%, to 2.0% of Si, to 4.0% of Mn to 4.0% of Ni and to 4.0% of Cu, the {Ni+(Mn+Cu)/3} being not less than 0.5% but not more than 5.0%, is continuously passed through a heating zone where it is heated to form a two-phase of ferrite and austenite and the heated strip is cooled at a cooling rate sufficient to transform the austenite to martensite. The product has high strength and elongation reduced plane anisotropy and hardness of at least HV 200.

13 Claims, 6 Drawing Sheets

50 μm

PROCESS FOR THE PRODUCTION OF A STRIP OF A CHROMIUM STAINLESS STEEL OF A DUPLEX STRUCTURE HAVING HIGH STRENGTH AND ELONGATION AS WELL AS REDUCED PLANE ANISOTROPY

FIELD OF THE INVENTION

The present invention relates to a novel process for the commercial production of a strip of high strength chromium stainless steel of a dual phase structure having excellent elongation as well as reduced plane anisotropy regarding strength and elongation. The product is useful as a material to be formed into shapes, by e.g. press-forming, which are required to have high strength.

BACKGROUND OF THE FIELD

Chromium stainless steels containing chromium as a main alloying element are classified into martensitic and ferritic stainless steels. They are inexpensive when compared with austenitic stainless steels containing chromium and nickel as main alloying elements, and have properties, including ferromagnetism and small thermal expansion coefficient, which are not found in austenitic stainless steels. Accordingly, there are many applications in which chromium stainless steels are used not only for economical reasons but also in view of their properties. Particularly, in the field of parts and attachments of electronic instruments and precision machines where chromium stainless steel sheets are used, as the demand is increasing in recent years, requirements for high efficiency, miniaturization, integration and high precision of worked products as well as simplification of the working process are becoming more and more severe. Thus, in addition to the corrosion resistance inherent to stainless steels and the above-mentioned properties of chromium stainless steels, chromium stainless steel sheets as a material for working are required to have still higher strength, better workability and more precision. Accordingly, chromium stainless sheets as a material for working, which have a combination of high strength and high elongation conflicting each other, and which are excellent in thickness precision before working and in shape precision after working, are desired in the art.

PRIOR ART

Regarding the strength of conventional chromium stainless steel sheet materials, it is well-known that martensitic stainless steels have great strength. For example, 7 species of martensitic stainless steel are prescribed in JIS G 4305 relating to cold rolled stainless steel sheets. The carbon content of these martensitic stainless steels ranges from up to 0.08% (for SUS410S) to 0.60–0.75% (for SUS440A). They contain higher C when compared with ferritic stainless steels of the same Cr level, and high strength can be imparted to by quenching treatment or by quenching and tempering treatment. For example, it is disclosed in JIS G 4305 that SUS420J2 containing 0.26–0.40% of C and 12.00–14.00% of Cr hardens to at least HRC 40 by quenching from 980°–1040° C. followed by tempering (heating at 150°–400° C. and allowing to cool in air), and that SUS440A containing 0.60–0.75% of C and 16.00–18.00% of Cr also hardens to at least HRC 40 by quenching from 1010°–1070° C. followed by tempering (heating at 150°–400° C. and allowing to cool in air).

On the other hand with ferritic stainless steel sheets of chromium stainless steel, hardening by heat-treatment is not so much expected, and therefore, it is practiced to increase the strength by work hardening. The method comprises annealing and cold temper rolling. However, the fact is such that ferritic stainless steels are not attractive in applications where high strength is required.

PROBLEMS

In the quenched or quenched and tempered condition, martensitic stainless steel sheets have basically martensitic structure, and have great strength and hardness. But elongation is extremely poor in that condition. Accordingly, once quenched or quenched and tempered, subsequent working or forming is very difficult. In particular, working or forming such as press-forming is impossible after quenching or after quenching and tempering. Accordingly, any working or forming is carried out prior to quenching or quenching and tempering treatment. Usually, a steel maker delivers the material in the annealed condition, that is in a soft condition of low strength and hardness as shown in Table 16 of JIS G 4305 to a working or forming processor, where the material is worked or formed to a shape approximate to that of the final product and thereafter subjected to quenching or quenching and tempering treatment. In many cases surface oxide film or scale formed by the quenching or quenching and tempering treatment is undesirable with stainless steels where surface prettiness is important. Thus, It becomes necessary for the working or forming processor to carry out the heat treatment of the shaped final product in vacuum or in an inert gas atmospherer or to remove scale from the shaped product. The burden of heat treatment at the processor side necessarily increases the cost of the product.

Ferritic stainless steel sheets whose strength has been increased by temper rolling have poor workability because of their poor strength elongation balance due to the elongation markedly reduced by the temper rolling. Further, temper rolling increased the proof stress of the material rather than the tensile strength thereof. In consequence, with a material temper rolled at a high reduction rate, a difference between the proof stress and tensile strength becomes small, and the yield ratio (a ratio of proof stress to tensile strength) approaches 1, rendering the plastic workable range of the material narrow. Generally, a material of high proof stress does not has a good shape after forming such a press-forming because of its great spring-back. Moreover, a temper rolled material exhibits significantly prominent plane anisotropy regarding strength and elongation. Because of these reasons a temper rolled material is not necessarily formed to a good shape every by slight press-forming. Further, as is known, when a steel sheet is rolled, the nearer the surfaces of the sheet the greater the strain. Thus, a temper rolled material inevitably poses a problem of a non-uniform distribution of strain in a direction of thickness, and in turn non-uniform distribution of residual stress in a direction of thickness, which can be a cause of a shape distortion, such as a wrap of sheet, appearing in ultra-thin sheets after they have been subjected to forming holes by a photo-etching process or to blanking. The shape distortion is serious in applications, such as electronic parts, where high precision is required. In addition to the above-mentioned problems relating to their properties, temper rolled materials pose many other problems relating to the management of their manufacture. Regarding control of the strength, since work hardening by cold rolling is utilized in temper rolling, the reduction rate is the most important factor determining the strength. Accordingly, in order that products of desired thickness and strength are precisely and stably produced, severe control of the reduction rate as well as severe control of the initial thickness and strength of the material prior to temper rolling is necessary. Regarding control of the shape, cold rolling of a reduction rate of several tens % is contemplated here where increase of strength is aimed, different from skin-pass rolling or other rolling of a reduction rate of at most 2 or 3% where rectification of shape is aimed. By cold rolling of a reduction rate of several tens % it is difficult to provide a product having a precise shape in the cold rolled condition. It is often necessary, therefore, to subject the as cold rolled material to a treatment for the removal of stress, in which the material is heated, for the purpose of the rectification of the shape, to a temperature which is lower than the recovery-recrystallization temperature of the material and at which the material is not softened.

In addition to the above-described problems owing to temper rolling, ferritic stainless steel sheets involve a problem of ridging, which may be said inherent thereto. While a ridging is a kind of surface defects normally formed on surfaces of a cold rolled and annealed sheet of a ferritic stainless sheet when it is press-formed, surface defects called cold rolling ridgings are frequently found on surfaces of a temper rolled sheet of a ferritic stainless steel. Formation of such ridging is a serious problem in applications where surface flatness is important.

MEASURES TO SOLVE THE PROBLEMS

The problems noted above will be solved, if a chromium stainless steel having moderately high strength, good elongation and formability enabling the steel to be formed into a desired shape, reduced anisotropy and no problems of ridging will be provided in the form of a strip at the side of a steel maker. For this purpose, an extensive research work on chromium stainless steels has been carried out, in both the aspects of the steel composition and the manufacturing process. As a result, it has now been found that substantially all of the above-mentioned problems are successfully solved by a process according to the invention for the production of a strip of a chromium stainless steel of a duplex structure consisting essentially of ferrite and martensite, having high strength and elongation as well as reduced plane anisotropy and having a hardness of at lest HV 200, which process comprises:

a step of hot rolling a slab of a steel to provide a hot rolled strip, said steel comprising, by weight, in addition to Fe, from 10.0% to 20.0% of CR, up to 0.105% of C, up to 0.12% of N, the (C+N) being not less than 0.01% but not more than 0.20%, up to 2.0% of Si, up to 4.0% of Mn, up to 4.0% of Ni and up to 4.0% of Cu, the {Ni+(Mn+Cu)/3} being not less than 0.5% but not more than 5.0%.

a step of cold rolling the hot rolled strip to provide a cold rolled strip of a desired thickness, with preference to at least two steps of cold rolling to provide a cold rolled strip of a desired thickness, including a step of intermediate annealing between the successive two cold rolling steps, said intermediate annealing comprising heating and maintaining the strip at a temperature to form a single phase of ferrite; and a step of continuous finish heat treatment in which the cold rolled strip is continuously passed through a heating zone where it is heated to a temperature ranging from the Ac1 point of the steel to 1100° C. to form a two-phase of ferrite and austenite and maintained at that temperature for not longer than 10 minutes, and the heated strip is cooled at a cooling rate sufficient to transform the austenite to martensite.

The invention not only solves the above-mentioned problems, but also provides a novel commercial process for the production of a strip of a chromium stainless steel. The process of the invention is advantageous in that the strength of the product can be freely and simply adjusted by controlling the steel composition, the heating temperature in the finish heat treatment, and/or the cooling rate in the finish heat treatment. The product of the process of the invention has a combination of strength and elongation which is not seen in commercially available martensitic or ferritic stainless steel strips, and exhibits reduced plane anisotropy regarding strength and elongation. The product of the invention is delivered to the market in the form of a coil of strip.

It was known in the art that when a typical ferritic stainless steel, for example SUS430, is heated to a temperature above the Ac1 point austenite is formed, and that when the steel so heated is then quenched the austenite is transformed to martensite, resulting in a duplex structure of ferrite and martensite. However, in the production of a cold rolled strip of a ferritic stainless steel capable of forming austenite at a high temperature, any heat treatment of the cold rolled strip has strictly been an annealing at a temperature under which a single phase of ferrite is stable. A heat treatment of the cold rolled strip at a temperature high enough to eventually form martensite has been commonly avoided as bringing about deterioration of quality such as elongation, and has been ignored in the commercial production of strips. Accordingly, so far as well known, there are no patents and metallurigical literatures in which a continuous heat treatment of a cold rolled strip of a chromium stainless steel is considered as in the invention, and in which on chromium stainless steel strips which have undergone a finish heat treatment comprising heating the cold rolled strip to a temperature high enough to form a two-phase of ferrite and austemite, the relationship between the tensile behavior and the heating temperature as well as the anisotropy regarding the strength and elongation are studied in detail. The invention provides a novel commercial process for the production of a high strength chromium stainless steel strip, and also provides, as a result, a novel chromium stainless steel material in the form of a strip having excellent properties which have not been possessed by conventional strips of chromium stainless steels.

DETAILED DESCRIPTION OF THE INVENTION

The invention will now be described in detail, in particular, regarding the chemical composition of the steel and the steps and conditions of the manufacturing process.

The steel employed in the process of the invention comprises, by weight, in addition to Fe, from 10.0% to 20.0% of Cr, up to 0.10% of C, up to 0.12% of N, the (C+N) being not less than 0.01% but not more than 0.20%, up to 2.0% of Si, up to 4.0% of Mn, up to 4.0% of Ni and up to 4.0% of Cu, the {Ni=(Mn+Cu)/3} being not less than 0.5% but not more than 5.0%.

Cr must be contained in an amount of at least 10.0% to achieve the desired level of corrosion resistence as stainless steels. However, as the Cr content increases, the amounts of austenite formers required for eventual formation of martensite to achieve high strength on the one hand, and the product becomes expensive on the other hand. Accordingly, the upper limit for Cr is now set as 20.0%. Chromium stainless steels containing up to 14.0% of Cr will be referred to herein as low Cr steels, while chromium stainless steels containing Cr in excess of 14.0% as high Cr steels.

C and N are strong and inexpensive austenite formers when compared with Ni, Mn and Cu, and have an ability of greatly strengthening martensite. Accordingly, they are effective to control and increase the strength of the product. We have found that although the steels contemplated herein contain Ni, Mn and Cu in such amounts that the {Ni+(Mn+Cu)/3} is not less than 0.5%, at least 0.01% of (C+N) is required to obtain a product of a duplex structure containing a substantial amount of martensite and having a hardness of at least HV200. On the other hand an excessively high content of (C+N) should be avoided, or otherwise the amount of martensite eventually formed increases, often to 100%, and the hardness of the formed martensite phase itself becomes unduly high, rendering the elongation of the product poor. The upper limit for (C+N) depends upon the particular Cr content. For low Cr steels (C+N) should be controlled not more than 0.12%. Whereas in steels of relatively high Cr (more than 14.0% of Cr) the (C+N) content up to 0.20% is permissible.

C is controlled at a level of not more than 0.10%, and in particular not more than 0.08% for low Cr steels. If C is excessively high, corrosion resistance of the product may be impaired, due to precipitation of Cr carbide in grain boundaries during the cooling step of the continuous heat treatment.

The upper limit for N depends upon the chromium content. For steels of a relatively high Cr, N may be up to 0.12%. Whereas for low Cr steels, N should preferably be controlled not in excess of 0.08%. The presence of an unduly high amount of N may be a cause of increase of surface defects.

Si is a ferrite former and acts to dissolve in both the ferrite and martensitic phases thereby to strengthen the product. The upper limit for Si is set as 2.0%, since the presence of an excessively high amount of Si adversely affects hot and cold workabilities of the product.

Mn, Ni and Cu are austenite formers and are useful for the control of the amount of martensite and the strength of the product. These elements makes it possible to reduce the amount of C needed thereby to enhance elongation of the product by formation of relatively soft martensite and to prevent deterioration of corrossion resistance of the product by suppression of precipitation of Cr carbide in grain boundaries. Further, it appears that addition of these elements renders the $Ac_1$ point of the steel lower, whereby the working temperature in the continuous finish heat treatment step of the process accordning to the invention may be lowered. The lower the working temperature, the more advantageous from view points of both saving energy and strength of the material being continuously processed. To enjoy these effects we have found that at least 0.5% of {Ni+(Mn+Cu)/3} is required. On the other hand, excessively hith amount of these elements should be avoided, or otherwise the amount of martensite eventually formed increases, often to 100%, rendering the elongation of the product poor. The upper limits for Mn, Ni and Couf are now set, in the cases of low Cr steels, as 3.0%, preferably 1.0% for Mn, 3.0% for Ni, 3.0% for Cu and 3.0% for {Ni+(Mn+Cu)/3}, respectively, and in the cases of high Cr steels, as 4.0% preferably 1.0% for mn, 4.0% for Ni, 4.0% for Cu and 5.0% for {Ni+(Mn+Cu)/3}, respectively. However, different from Ni and Cu, Mn may adversely affects oxidation resistance of the steel, whereby a lot of scale may be formed during the continuous heat treatment, leading to increase of the burden of pickling and/or deterioration of surface textures of the product. Further, Mn may adversely affect corrosion resistance of the product. For these reasons Mn is preferably controlled at a level of 1.0% or less, as is the case with conventional ferritic and martensitic steels.

In addition to the above-mentioned alloying elements, the steel of the invention may optionally contain at least one other useful element selected from up to 0.20% of Al, up to 0.0050% of b, up to 2.5% of Mo, up to 0.10% of REM (rare earth metals) and up to 0.20% of Y.

Al is an element effective of deoxygenation and serves to remarkably reduce $A_2$ inclusions which adversely affect press formability of the product. However, as the Al content approaches and exceeds 0.20%, such an effect of Al becomes saturated on the one hand, surface defects tend to increase on the other hand. Accordingly, the upper limit for Al is now set as 0.20%.

B is effective for improving the toughness of the product. While such an effect may be realized even with a trace of B, it becomes saturated as B approaches and exceeds 0.0050%. For this reason we set the upper limit for B as 0.0050%.

Mo is effective for enhancing corrosion resistance of the product. For an economical reason the upper for Mo is set as 2.5%.

REM and Y are effective for enhancing hot workability and oxidation resistance at a high temperature. They effectively serves to suppress formation of oxide scales during the continuous finish heat treatment carried out according to the invention at a high temperature thereby to provide a good surface texture after descaling. These effects tend to be saturated, however, as REM and Y approach and exceed 0.10% and 0.20%, respectively. Accordingly, the upper limits for REM and Y are now set as 0.10% for REM and 0.20% of Y, respectively.

Besides the above-mentioned useful alloying elements, the steel of the invention may contain residual amount of S, P and O.

As to S, the less the more preferable, since it is harmful to corrosion resistance and hot workability of the steel. The upper limit for S is now set as 0.030%.

P serves to strengthen the steel by dissolving therein. However, we set the upper limit for P as 0.040%, as prescribed in standards of conventional ferritic and martensitic steels, since P may adversely affect toughness of the product.

O forms non-metallic inclusions, and thereby impairs purity of the steel. For this reason the upper limit for O is set as 0.02%.

Thus, according to one embodiment of the invention the steel employed consists essentially of, by weight,:

up to 0.08% of C, up to 2.0% of Si,
up to 3.0% of Mn,
up to 0.040% of P,
up to 0.030% of S,
up to 3.0% of Ni,
from 10.0% to 14.0% of Cr,
up to 0.08% of N, the (C+N) being not less than 0.01% but not more than 0.12%,
up to 0.02% of O,
up to 3.0% of Cu, the {Ni+(Mn+Cu)/3} being not less than 0.5% but not more than 3.0%, and optionally at least one element selected from the group consisting of:
up to 0.20% of Al,
up to 0.0050% of B,
up to 2.5% of Mo,
up to 0.10% of REM and
up to 0.20% of Y, the balance being Fe and unavoidable impurities.

In accordance with another embodiment of the invention, the steel employed consists essentially of, by weight:
up to 0.10% of C,
up to 2.0% of Si,
up to 4.0% of Mn,
up to 0.040% of P,
up to 0.030% of S,
up to 4.0% of Ni,
more than 14.0% to 20.0% of Cr,
up to 0.12% of N, the (C+N) being not less than 0.01% but not more than 0.20%,
up to 0.02% of O,
up to 4.0% of Cu, the {Ni+(Mn+Cu)/3} being not less than 0.5% but notnore than 5.0%, and optionally at least one element selected from the group containing of:
up to 0.20% of Al,
up to 0.0050% of B,
up to 2.5% of Mo,
up to 0.10% of REM and
up to 0.20% of Y, the balance being Fe, and unavoidable impurities.

The process according to the invention comprises the steps of hot rolling, cold rolling and continuous finish heat treatment.

HOT ROLLING

A slab of chromium stainless steel having a selected chemical composition, which has been prepared by a conventional steel making and casting technique, is hot rolled to provide a hot rolled strip by a conventional technique. For example, the hot rolling is started at a temperature of about 1100° C. to 1200° C. and ends at a temperature of about 850° C. The hot rolled strip is then coiled at a temperature of about 650° C., and the coil normally having a weight of from about 8 to about 15 tons is allowed to cool in air. The cooling rate of such a coil is very slow. On the other hand, although the chromium stainless steel employed has a two-phase structure of austenite and ferrite at high temperatures at which it is hot rolled, a rate of transformation from the austenite to ferrite caused by temperature decrease is slower with the chromium stainless steel than with low carbon steels. Thus, in the strip of the invention as hot rolled those portions of the steel which were austenite at the high temperatures have not completely been transformed to ferrite. The steel of the invention in the hot rolled condition has a stratified band-like structure of a phase which comprises intermediates of the transformation from the austenite to ferrite, such as bainite, and a phase which has been the ferrite, both the phases being more or less elongated in the direction of hot rolling. The hot rolled strip is preferably annealed and descaled. The annealing of the hot rolled strip not only softens the material to enhance the cold rollability of the hot rolled strip, but also transformed and decomposes, to some extent, the above-mentioned intermediately transformed phase (which were austenite at the high temperatures of the hot rolling) in the as hot rolled strip to ferrite and carbides. Either continuous annealing or box annealing may be applied for annealing the hot rolled strip.

COLD ROLLING

The hot rolled strip, preferably after annealed and descaled, is col rolled to a desired thickness, which can be as thin as from about 0.1 mm to about 1.0 mm in cases wherein the product of the invention is intended to be used as a material for the fabrication of parts of electronic instruments and precision machines by press-forming.

The cold rolling may be carried out in a single step of cold rolling with no intermediate annealing. By the expression "a single step of cold rolling with no intermediate annealing", we mean to reduce the thickness of the strip from that of the hot rolled strip to a desired one of the cold rolled strip either by one-pass cold rolling or by multiple-pass cold rolling without any intermediate annealing, irrespective of the number of passes through rollers. The rolling rate of reduction in thickness may range from about 30% to about 95%. The product which has been cold rolled in a single step of cold rolling with no intermediate annealing, and thereafter finish heat treated will be referred to herein as a 1CR material.

Preferably, the cold rolling is carried out in at least two steps of cold rolling, including a step of intermediate annealing between the two successive cold rolling steps. The intermediate annealing comprises heating the cold rolled strip to a temperature at which a single phase of ferrite may be formed prior to the subsequent cold rolling. Apparently, the temperature for the intermediate annealing is below the $Ac_1$ point of the steel. In each cold rolling step the thickness of the strip is reduced by passing the strip, at least once, through rollers. The reduction rate in each cold rolling step is preferably at least about 30%. The product, which has been cold rolled in at least two steps of cold rolling with a step of intermediate annealing between the successive two cold rolling steps, and thereafter finish heat treated, will be referred to herein as a 2CR material. While 1CR materials have satisfactorily reduced plane anisotropy in respect of strength and elongation, the corresponding 2CR materials exhibit further reduced plane anisotropy.

The cold rolling is essential for the purposes of the invention. When the hot rolled strip, as such or after annealing, is subjected to the continuous finish heat treatment described herein, a two-phase structure of ferrite and martensite is basically realized. The structure obtained, however, more or less succeeds to that of the hot rolled strip, and comprises relatively large grains of ferrite and martensite aligned, respectively, in the direction of rolling, resulting in significant plane anisotropy in respect of strength and elongation. In contrast, when the hot rolled strip, preferably after annealing, is cold rolled, preferably in at least two steps with a step of intermediate annealing comprising heating the strip to a temperature to form a single phase of ferrite between the successive two cold rolling steps, and then subjected to the continuous finish heat treatment according to the invention, the stratified band-like structure of the steel in the hot rolled condition collapses and a duplex structure of uniformly admixed fine ferrite and martensite is obtained. Thus, the product of the invention exhibits reduced plane anisotropy in respect of strength and elongation, and has excellent workability or formability. Further, without cold rolling it is very difficult to prepare thin steel strips which meet severe requirements for thickness precision, shape precision and surface qualities.

CONTINUOUS FINISH HEAT TREATMENT

The cold rolled strip is continuously passed through a heating zone where it is heated to a temperature ranging from the Ac1 point of the steel to 1100° C. to form a two-phase of ferrite and austenite and maintained at that temperature for not longer than 10 minutes, and the heated strip is cooled at a cooling rate sufficient to transform the austenite to martensite.

In the continuous finish heat treatment according to the invention, it is essential to heat the cold rolled strip to a temperature at which a two-phase of ferrite and austenite may be formed, that is to a temperature not lower than the $Ac_1$ point of the steel. However, in a continuous heat treatment using a temperature near the $Ac_1$ point of the steel, the amount of austenite formed significantly varies with a slight change of the temperature, and in consequence there is frequently a case wherein a desired level of hardness is not stably obtained after quenching. We have found that such undesirable variations of hardness can be avoided if a heating temperature of at least about 100° C. above the $Ac_1$ point of the steel is used. Thus, a preferable heating temperature in the continuous heat treatment of the invention is at least about 100° C. above the $Ac_1$ point of the steel, more specifically, at least about 850° C., and more preferably, at least about 900° C. The upper limit for the heating temperature is not very critical. Generally, the higher the temperature, the more the steel is strengthened. However, as the heating temperature approaches 1100° C., the strengthening effect becomes saturated or occasionally even decreased, and the energy consumption is increased. Accordingly, we set the upper limit for the heating temperature as about 1100° C.

As to metallurgical significances of the heating of the cold rolled strip to a temperature at which a two-phase structure of ferrite and austenite is formed, we can mention dissolution of Cr carbide and nitride, formation of austenite and concentration of C and N into the formed austenite. For the steels concerned here, there phenomena reach equilibrium within a short period of time. Accordingly, the heating time for which the material being treated is maintained at the required temperature can be as short as not more than about 10 minutes. This shortness of the heating time renders the process of the invention advantageous from view points of production efficiency and manufacturing costs. By the above-mentioned heating conditions it is possible to form an amount of austenite sufficient to eventually provide at least about 10% (in case of high Cr steels) or at least about 20% (in cases of low Cr steels) by volume of martensite.

The cooling rate in the continuous finish heat treatment should be sufficient to transform the austenite to martensite. Practically, a cooling rate of at least about 1° C./sec, preferably at least about 5° C./sec may be used. The upper limit for the cooling rate is not critical but a cooling rate in excess of about 500° C. will not be practical. The cooling rate prescribed above is maintained until the austenite has been transformed to martensite. It should be appreciated that after the transformation has been completed the cooling rate is not critical. The cooling of the strip may be carried out either by application of a gaseous or liquid cooling medium to the strip or by roll cooling using water-cooled rolls. It is convenient to carry out the continuous heat treatment of the cold rolled strip according to the invention by continuously uncoiling a coil of the cold rolled strip, passing it through a continuous heat treatment furnace having heating and quenching zones, and coiling the treated strip.

The invention will be further described by the following Examples with reference to the attached drawings in which FIG. 1A is a graph showing the dependency of the amount of martensite and FIG. 1B is a graph showing the dependency of the hardness on 1CR products upon the heating temperature in the finish heat treatment;

EXAMPLE 1

This example relates to experiments demonstrating the dependence of the amount of martensie and the hardness of 1CR products upon the heating temperature in the finish heat treatment.

TABLE 1

| | (in % by weight) | | | | | | | | | | |
|---|---|---|---|---|---|---|---|---|---|---|---|
| Steel | C | Si | Mn | P | S | Ni | Cr | N | Al | O | Cu |
| A | 0.038 | 0.35 | 0.38 | 0.021 | 0.005 | 0.48 | 12.03 | 0.021 | <0.005 | 0.012 | 0.35 |
| B | 0.047 | 0.42 | 0.29 | 0.019 | 0.009 | 1.04 | 16.18 | 0.014 | <0.005 | 0.019 | 0.05 |
| C | 0.089 | 0.46 | 0.38 | 0.020 | 0.009 | 0.08 | 16.42 | 0.010 | <0.005 | 0.013 | 0.06 |

Figure 1A:
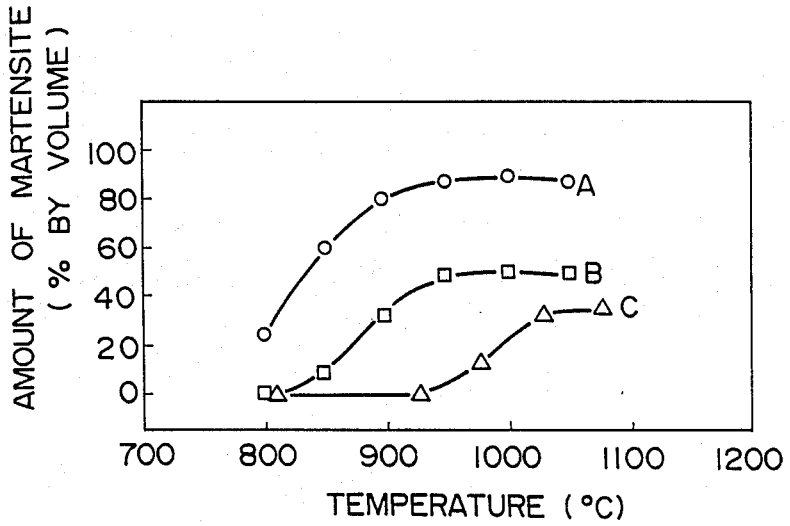
Figure 1B:
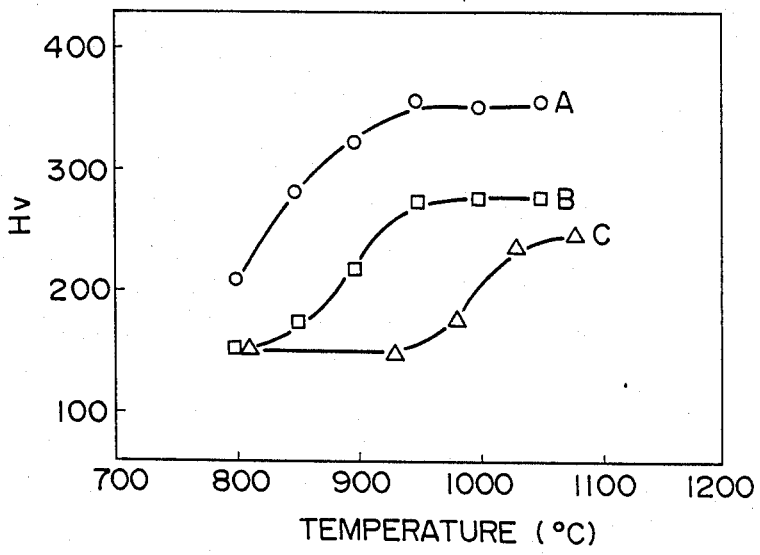

Steels A, B and C having chemical compositions indicated in Table 1 were cast, hot rolled to a thickness of 3.6 mm, annealed at a temperature of 780° C. for 6 hours in a furnace, air cooling in the same furnace, pickled and cold rolled to a thickness of 0.7 mm (a reduction rate of 80.6%) in a single step of cold rolling with no intermediate annealing. Sheets cut from each cold rolled material were heated at various temperatures ranging from 800° C. to 1100° C. for about 1 minute and cooled at an average cooling rate of about 20° C./sec, to ambient temperature. The amount of martensite (% by volume) and the hardness (HV) of the products were determined. The results are shown in FIG. 1, in which symbols A, B and C designate Steels A, B and C, respectively. Steels A and B are within the scope of the invention, whereas Steel C is not since it does not contain at least 0.5% of {Ni+(Mn+Cu)/3}.

FIG. 1 shows that as the heating temperature in the finish heat treatment is raised to exceed 800° C. and possibly the $Ac_1$ point of the steel, martensite is started to be formed after the finish heat treatment and that the amount of martensite formed increases, as the temperature is further raised. Regarding Steels A and B within the scope of the invention, a rate of increase of the martensite becomes smaller when the temperature exceeds about 850° to 900° C. and the amount of martensite tends to be saturated. FIG. 1 further shows that the hardness similarly behaves to the heating temperature and that the more the amount of martensite the higher the hardness. When compared with Steels A and B, Steel C which does not contain Ni, Mn and Cu in amounts prescribed herein, has a higher and narrower range of temperature for saturation of the amount of martensite eventually formed and for saturation of the final hardness;

In an actual continuous heat treatment line some variations in temperature (deviations of plus minus about 20° C. from the target temperature), longitudinally of one strip and between different strips, are unavoidable. FIG. 1 shows that that there is a certain range of temperature within which variations in hardness, and in turn variations in strength, with changes of the temperature is relatively small. We prefer to carry out the continuous heat treatment of the invention, using a heating temperature in such a range, that is from at least about 100° C. above the $Ac_1$, point of the steel to about 1100° C., more specifically, from about 850°-900° C. to about 1100° C. By doing so, strips in which variations in strength are small, longitudinally of one strip and between different strips, will be stably obtained, using an existing continuous heat treatment line.

EXAMPLE 2

This example relates to experiments demonstrating properties of a 1CR material of a duplex structure compared with those of a temper rolled material of the same chemical composition. The tested materials were prepared by the processes as noted below.

(1) 1CR material

Figure 2:
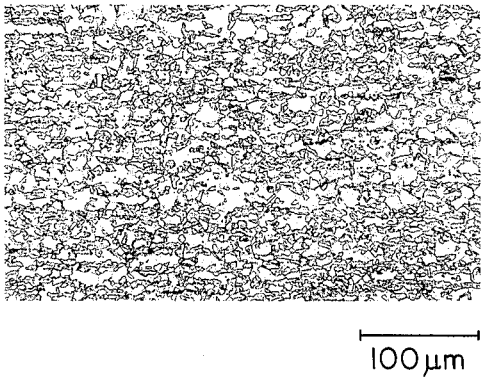
FIG. 2 is a photo showing a metallic structure of a 1CR product.

A hot rolled sheet of Steel B of a thickness of 3.6 mm was annealed at a temperature of 780° C. for 6 hours in a furnace, allowed to cool in the same furnace, pickled, cold rolled to a thickness of 0.7 mm (a reduction rate of 80.6%) in a single step of cold rolling with no intermediate annealing, heated at a temperature of about 1000° C. for about 1 minute and cooled at an average cooling rate of about 20° C./sec. to ambient temperature. FIG. 2 is a photo showing the metallic structure of the material so prepared. In the photo, areas appearing white are ferrite, while areas appearing dark or grey are martensite. It can be seen that the material has a duplex structure of uniformly admixed fine ferrite and martensite grains.

(2) Temper rolled material

A hot rolled sheet of Steel B of a thickness of 3.6 mm was annealed at a temperature of 780° C. for 6 hours in a furnace and allowed to cool in the same furnace, pickled, cold rolled to a thickness of 2.5 mm, annealed at a temperature of 720 ° C. for 1 minute, air cooled, and temper rolled to a thickness of 0.7 mm.

Specimens of both the materials were tested for tensile strength (kgf/mm$^2$) and elongation (%) in directions of, 0° (L), 45° (D) and 90° (T) to the rolling direction, as well as hardness. The results are shown in Table 2 below.

TABLE 2

| Process | Hardness (HV) | Tensile strength (kgf/mm$^2$) L | D | T | Elongation (%) L | D | T |
|---|---|---|---|---|---|---|---|
| (1) | 275 | 96.8 | 88.7 | 96.6 | 10.4 | 13.6 | 8.8 |
| (2) | 286 | 94.2 | 98.8 | 108.6 | 2.7 | 1.1 | 0.6 |

(1): 1 CR material of duplex structure finish heat treated at 1000° C.
(2): Temper rolled material temper rolled at a reduction rate of 72%

Table 2 reveals that the 1CR material of a duplex structure has remarkably high elongation in all directions when compared with the temper rolled material of the same chemical composition having the same level of hardness and strength. Table 2 further reveals that the 1CR material of a duplex structure exhibits improved plane isotropy in respect of strength and elongation when compared with the temper rolled material of the same chemical composition having the same level of hardness and strength.

EXAMPLE 3

This example relates to experiments demonstrating the dependence of the amount of martensie and the hardness of low Cr 2CR products upon the heating temperature in the finish heat treatment.

TABLE 3

| Steel | C | Si | Mn | P | S | Ni | Cr | N | Al | O | Cu |
|---|---|---|---|---|---|---|---|---|---|---|---|
| | (in % by weight) | | | | | | | | | | |
| D | 0.023 | 0.53 | 0.44 | 0.017 | 0.006 | 0.15 | 12.18 | 0.008 | <0.005 | 0.009 | 0.05 |
| E | 0.026 | 0.29 | 0.17 | 0.016 | 0.005 | 0.73 | 13.49 | 0.018 | 0.010 | 0.010 | 0.04 |
| F | 0.038 | 0.35 | 0.38 | 0.021 | 0.005 | 0.48 | 12.03 | 0.021 | <0.005 | 0.011 | 0.35 |

Figure 3A:
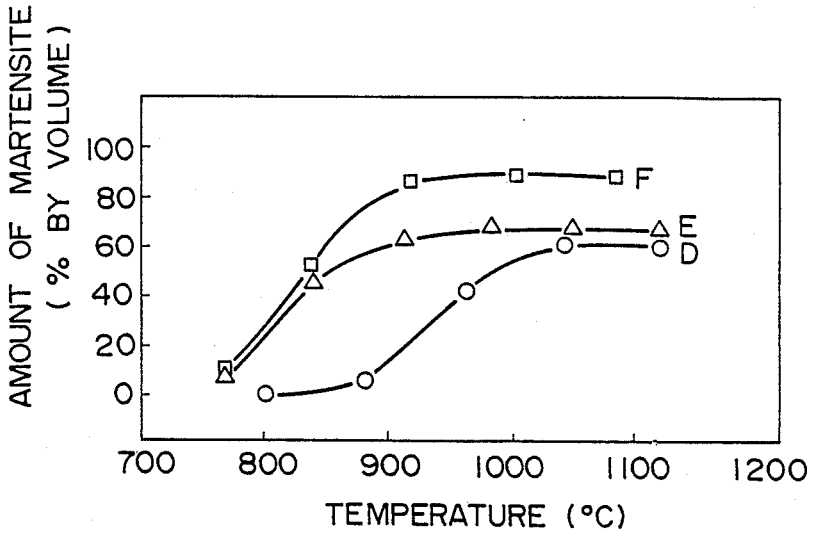
FIG. 3A is a graph showing the dependency of the amount of martensite and FIG. 3B is a graph showing the dependency of the hardness on low Cr 2CR products upon the heating temperature in the finish heat treatment.
Figure 3B:
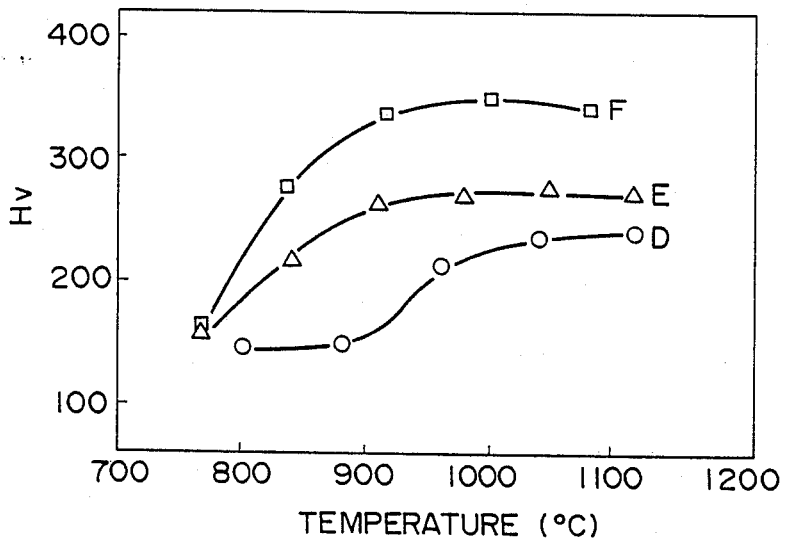

Steels D, E and F having chemical compositions indicated in Table 3 were cast, hot rolled to a thickness of 3.6 mm, annealed at a temperature of 780° C. for 6 hours in a furnace, allowed to cool in the same furnace, pickled and cold rolled to a thickness of 1.0 mm, annealed at a temperature of 750° C. for 1 minute, air cooled, and cold rolled to a thickness of 0.3 mm. Sheets cut from each cold rolled material were heated at various temperatures ranging from 800° C. at 1100° C. for about 1 minute and cooled at an average cooling rate of about 20° C./sec. to ambient temperature. The amount of martensite % (by volume) and the hardness (HV) of the products were d results are shown in FIG. 3, in which symbols D, E and F designate Steels D, E and F, respectively. Steels E and F are within the scope of the invention, whereas Steel D is not since it does not contain at least 0.5% of {Ni+(Mn+Cu)/3}. The same obsrevations as those here-in-before made on FIG. 1, will be made on FIG. 3.

EXAMPLE 4

This example relates to experiments demonstrating properties of a low Cr 2CR material of a duplex structure compared with those of 1CR and temper rolled materials of the same chemical composition. The tested materials were prepared by the processes as noted below.

(3) 2CR material

Figure 4:
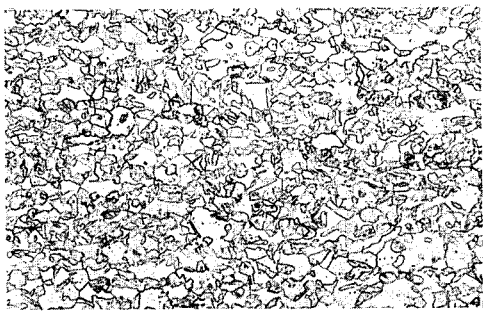
FIG. 4 is a photo showing a metallic structure of a low Cr 2CR product.

A hot rolled sheet of Steel E of a thickness of 3.6 mm was annealed at a temperature of 780° C. for 6 hours in a furnace, allowed to cool in the same furnace, pickled, cold rolled to a thickness of 1.0 mm, annealed at a temperature of about 750° C. for 1 minute, air cooled and cold rolled to a thickness of 0.3 mm. The sheet was heated at a temperature of 960° C. for about 1 minute and cooled at an average cooling rate of about 20° C./sec. to ambient temperature. FIG. 4 is a photo showing the metallic structure of the material so prepared. In the photo, areas appearing white are ferrite, while areas appearing dark or grey are martensite. It can be seen that the material has a duplex structure of uniformly admixed fine ferrite and martensite grains.

(4) 1CR material

The process (3) above was repeated except that the hot rolled, annealed and pickled sheet was cold rolled to a thickness of 0.3 mm in a single step of cold rolling with no intermediate annealing.

(5) Temper rolled material

A hot rolled sheet of Steel E of a thickness of 3.6 mm was annealed at a temperature of 780° C. for 6 hours in a furnace, allowed to cool in the same furnace, pickled, cold rolled to a thickness of 1.1 mm, annealed at a temperature of 750° C. for 1 minute and temper rolled to a thickness of 0.3 mm.

Specimens of the materials prepared were tested for tensile strength (kgf/mm$^2$) and elongation (5) in directions of, 0° (L), 45° (D) and 90° (T) to the rolling direction, as well as hardness. The results are shown in Table 4 below.

TABLE 4

| Process | Hardness (HV) | Tensile strength (kgf/mm$^2$) L | D | T | Elongation (%) L | D | T |
|---|---|---|---|---|---|---|---|
| (3) | 269 | 85.9 | 88.0 | 87.4 | 13.3 | 12.8 | 14.5 |
| (4) | 272 | 93.7 | 85.6 | 93.8 | 11.2 | 13.2 | 9.8 |
| (5) | 268 | 87.8 | 94.1 | 97.9 | 2.6 | 1.2 | 0.6 |

(3): 2 CR material of a duplex structure finish heat treated at 960° C.
(4): 1 CR material of a duplex structure finish heat treated at 960° C.
(5): Temper rolled material temper rolled at a reduction rate of 73%

Table 4 reveals that when compared with the temper rolled material of the same chemical composition having the same level of hardness and strength, both the 1CR and 2CR materials of a duplex structure have remarkably high elongation in all directions, and exhibit improved plane isotropy in respect of strength and elongation. Table 4 further reveals the preference of the 2CR material to the 1CR material in view of the further reduced plane anisotropy of the former.

EXAMPLE 5

This example relates to experiments demonstrating the dependence of the amount of martensie and the hardness of high CR 2CR products upon the heating temperature in the finish heat treatment.

TABLE 5

| Steel | C | Si | Mn | P | S | Ni | Cr | N | Al | O | Cu |
|---|---|---|---|---|---|---|---|---|---|---|---|
| | (in % by weight) | | | | | | | | | | |
| G | 0.089 | 0.49 | 0.38 | 0.020 | 0.009 | 0.08 | 16.42 | 0.010 | <0.005 | 0.013 | 0.06 |
| H | 0.045 | 0.43 | 0.37 | 0.019 | 0.010 | 1.53 | 15.60 | 0.023 | <0.005 | 0.016 | 0.11 |

Figure 5A:
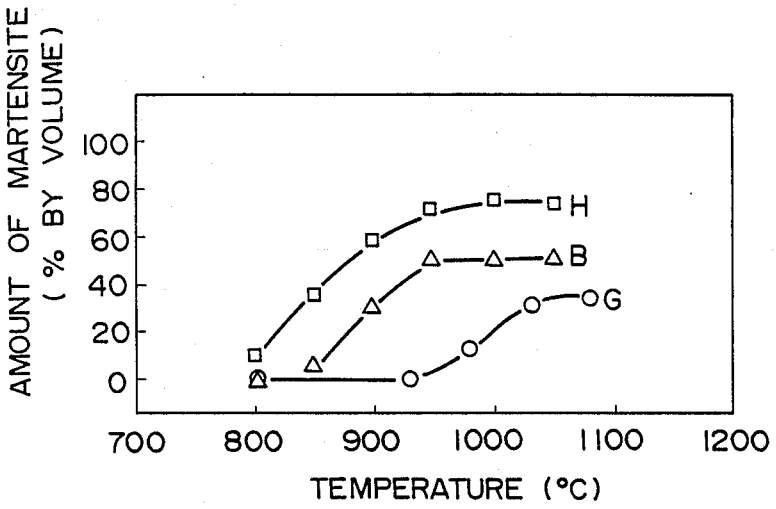
FIG. 5A is a graph showing the dependency of the amount of martensite and FIG. 5B is a graph showing the dependency of the hardness on high CR 2CR products upon the heating temperature in the finish heat treatment.
Figure 5B:
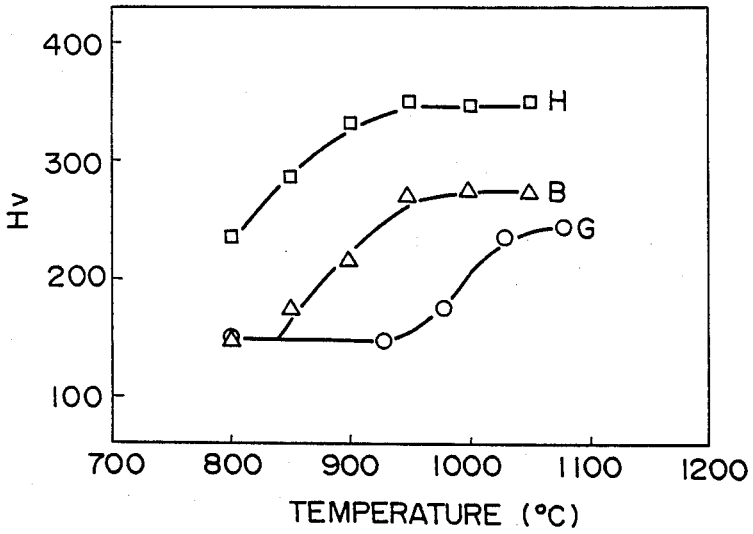
Figure 6:
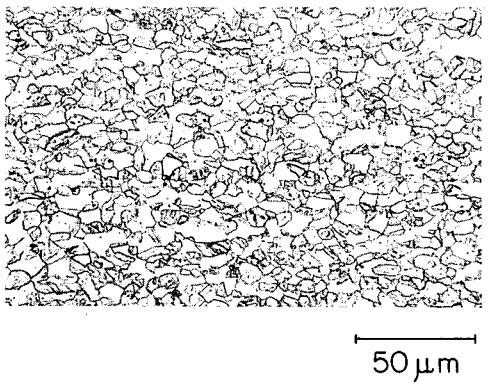
FIG. 6 is a photo showing a metallic structure of a high Cr 2CR product.

Steels G and H having chemical compositions indicated in Table 5 and Steel B of Table 1 were cast, hot rolled to a thickness of 3.6 mm, annealed at a temperature of 780° C. for 6 hours in a furnace, allowed to cool in the same furnace, pickled and cold rolled to a thickness of 1.0 mm, annealed at a temperature of 750° C. for 1 minute, air cooled, and cold rolled to a thickness of 0.3 mm. Sheets cut from each cold rolled material were heated at various temperatures ranging from 800° C. at 1100° C. for about 1 minute and cooled at an average cooling rate of about 20° C./sec. to ambient temperature. The amount of martensite (% by volume) and the hardness (HV) of the products were determined. The results are shown in FIG. 5, in which symbols G, H and B designate Steels G, H and B, respectively. Steels B and H are within the scope of the invention, whereas Steel G is not since it does not contain at least 0.5% of {Ni+(Mn+Cu)/3}. The same obsrevations as those here-inbefore made on FIG. 1, will be made on FIG. 5.

EXAMPLE 6

This example relates to experiment demonstrating properties of a high Cr 2CR material of a duplex structure compared with those of 1CR and temper rolled materials of the same chemical composition. The tested material were prepared by the processes as noted below.

(6) 2CR material

The process (3) above was repeated except that Steel B was used instead of Steel E and that the cold rolled sheet was final heat treated at 1000° C. instead of 960° C.

(7) 1CR material

The process (4) above was repeated except that Steel B was used instead of Steel E and that the cold rolled sheet was final heat treated at 1000° C. instead of 960° C.

(8) Temper rolled material

The process (5) above was repeated except that Steel B was used instead of Steel E and that the hot rolled, annealed and pickled sheet was cold tolled to a thickness of 1.8 mm.

Specimens of the materials prepared were tested for tensile strength (kgf/mm$^2$) and elongation (%) in directions of, 0° (L), 45° (D) and 90° (T) to the rolling direction, as well as hardness. The results are shown in Table 6 below.

TABLE 6

| Process | Hardness (HV) | Tensile strength (kgf/mm$^2$) L | D | T | Elongation (%) L | D | T |
|---|---|---|---|---|---|---|---|
| (6) | 280 | 92.5 | 92.2 | 92.5 | 11.1 | 11.1 | 10.4 |
| (7) | 278 | 96.6 | 88.5 | 96.7 | 9.1 | 12.7 | 7.0 |

TABLE 6-continued

| Process | Hardness (HV) | Tensile strength (kgf/mm²) L | D | T | Elongation (%) L | D | T |
|---|---|---|---|---|---|---|---|
| (8) | 285 | 94.2 | 95.1 | 106.4 | 2.1 | 0.9 | 0.6 |

(6): 2 CR material of a duplex structure finish heat treated at 1000° C.
(7): 1 CR material of a duplex structure finish heat treated at 1000° C.
(8): Temper rolled material temper rolled at a reduction rate of 83%

Table 6 reveals that when compared with the temper rolled material of the same chemical composition having the same level of hardness and strength, both the 1CR and 2CR materials of a duplex structure have remarkably high elongation in all directions, and exhibit improved plane isotropy in respect of strength and elongation. Table 4 further reveals the preference of the 2CR material to the 1CR material in view of the further reduced plane anisotropy of the former.

EXAMPLE 7–18

These examples illustrate commercial production of 1CR materials according to the invention, using a continuous heat treatment furnace, Steels having chemical compositions indicated in Table 7 were case, hot rolled to a thickness of 3.6 mm, annealed at a temperature of 780° C. for 6 hours in a furnace, allowed to cool in the same furnace, pickled and cold rolled to a thickness of 0.7 mm (a reduction rate of 80.6%) in a single step of cold rolling with no intermediate annealing. Each cold rolled strip was continuously finish heat treated in a continuous heat treatment furnace under conditions indicated in Table 8 with a time of uniform heating of 1 minute, except for in Examples 17 and 18. In Example 17 the cold rolled strip was heated in a box furnace with a time of uniform heating of about 6 hours and allowed to cool in the same furnace. In Example 18 a hot rolled strip of Steel 1 of a thickness of 3.6 mm was annealed at a temperature of 780° C. for 6 hours in a furnace, allowed to cool in the same furnace, pickled, cold rolled to a thickness of 2.0 mm, annealed at a temperature of 720° C. for 1 minute, air cooled and temper rolled to a thickness of 0.7 mm. Specimens of the products were tested for 0.2% proof stress, tensile strength and elongation in directions of 0° (longitudinally), 45° (diagonal) and 90° (transverse) to the direction of rolling, and for amount of martensite and hardness. On broken specimens from the tensile test, yes or no of ridging occurrence was observed. The results are shown in Table 8.

Examples 7–13 are in accordance with the invention, whereas Examples 14–18 are controls.

As seen from Table 8, steel strips of a duplex structure containing from about 35 to about 75% by volume of martensite having a combination of great strength and harness as well as good elongation were obtained by processes of Examples 7–13 according to the invention. The products of the invention exhibited reduced plane anisotropy in respect of 0.2% proof stress, tensile strength and elongation.

In contrast, Steel 8 used in Example 14 had a {Ni+(Mn+Cu)/3} content as low as 0.24%, and in consequence, no martensite was formed by the continuous finish heat treatment. The product of Example 14 had poor strength and hardness.

Steel 9 used in Example 15 had a carbon content of 0.405% in excess of 0.10% and a Ni content of 5.07% in excess of 4.0%, and thus, the product had a 100% martensitic structure after the continuous heat treatment, leading to a combination of great strength with poor elongation.

At the heating temperature of the continuous finish heat treatment (750° C.) used in Example 16, Steel 1 employed did not form a two-phase of ferrite and austenite. Accordingly, the product after the finish heat treatment had a single phase structure of ferrite, exhibiting a combination of high elongation with poor strength and hardness.

In Example 17, the cold rolled strip of Steel 1 was heated in a box furnace and allowed to cool in the same furnace at an insufficient cooling rate of 0.03° C./sec for transformation of austenite to martensite. Accordingly, the product after the heat treatment contained no martensite transformed exhibiting a combination of high elongation with poor strength and hardness, as was the case in Example 16.

The product of Example 18 was a temper rolled material which had, when compared with the products of the invention, remarkably low elongation, high yield ratio (a ratio of 0.2% proof stress to tensile strength) and prominent plane anisotropy in respect of 0.2% proof, tensile strength and elongation. Apparently, such a product is inferior to the products of the invention regarding workability or formability and shape precision after worked or formed.

Table 8 further reveals that broken specimens from the tensile test of Examples 14, 16, 17 and 18 showed occurrence of ridging. In contrast the products of the invention were completely free from the problem of riding. This means that the products of the invention work well in press-forming.

TABLE 7

| Steel | C | Si | Mn | P | S | Ni | Cr | N | Al | O | Cu | Others |
|---|---|---|---|---|---|---|---|---|---|---|---|---|
| | (in % by weight) | | | | | | | | | | | |
| 1 | 0.025 | 0.31 | 0.16 | 0.015 | 0.005 | 0.70 | 13.21 | 0.017 | <0.005 | 0.012 | 0.06 | |
| 2 | 0.021 | 0.55 | 0.85 | 0.019 | 0.006 | 2.61 | 16.63 | 0.009 | 0.150 | 0.005 | 0.04 | |
| 3 | 0.089 | 0.42 | 0.35 | 0.019 | 0.005 | 0.22 | 16.85 | 0.072 | 0.162 | 0.006 | 0.77 | |
| 4 | 0.048 | 1.63 | 0.52 | 0.018 | 0.006 | 1.20 | 16.48 | 0.022 | 0.005 | 0.014 | 0.57 | |
| 5 | 0.073 | 0.41 | 0.45 | 0.018 | 0.006 | 0.53 | 16.41 | 0.025 | 0.011 | 0.008 | 0.05 | B 0.0021 |
| 6 | 0.034 | 0.30 | 0.72 | 0.015 | 0.005 | 0.73 | 13.07 | 0.009 | 0.020 | 0.008 | 0.05 | Mo 0.60 |
| 7 | 0.043 | 0.42 | 2.21 | 0.019 | 0.001 | 1.15 | 18.15 | 0.018 | <0.005 | 0.011 | 0.05 | REM 0.029, Y 0.035 |
| 8 | 0.011 | 0.49 | 0.41 | 0.018 | 0.005 | 0.09 | 18.56 | 0.009 | 0.029 | 0.007 | 0.05 | |
| 9 | 0.405 | 0.45 | 0.31 | 0.018 | 0.005 | 5.07 | 17.45 | 0.014 | <0.005 | 0.010 | 0.05 | |

TABLE 8

| | | Finish heat treatment | | Properties(3) | | | | | | | | | | | |
|---|---|---|---|---|---|---|---|---|---|---|---|---|---|---|---|
| | | | | | 0.2% proof (kgf/mm²) | | | Tensile strength (kgf/mm²) | | | Elongation (%) | | | Hardness | |
| Ex(1) | St(2) | tempera-ture °C. | rate of cooling °C./sec | Amount of martensite (% by vol) | L | D | T | L | D | T | L | D | T | Hv | ridging |
| 7 | 1 | 980 | 100 | 71.5 | 64.1 | 62.2 | 65.7 | 93.8 | 92.1 | 94.5 | 11.0 | 11.7 | 9.1 | 280 | No |
| 8 | 2 | 1050 | 25 | 45.8 | 45.1 | 43.8 | 43.3 | 84.2 | 82.1 | 83.1 | 2.9 | 16.1 | 13.1 | 237 | No |
| 9 | 3 | 1000 | 15 | 51.5 | 62.2 | 61.1 | 61.8 | 92.7 | 91.7 | 94.8 | 10.4 | 12.3 | 9.1 | 291 | No |
| 10 | 4 | 1050 | 150 | 35.6 | 50.1 | 48.8 | 48.3 | 88.2 | 86.1 | 88.0 | 12.4 | 15.6 | 12.0 | 256 | No |
| 11 | 5 | 980 | 25 | 53.9 | 62.8 | 61.7 | 62.4 | 94.1 | 92.2 | 95.1 | 10.3 | 11.6 | 8.7 | 295 | No |
| 12 | 6 | 880 | 95 | 72.5 | 64.2 | 58.8 | 62.1 | 98.1 | 95.2 | 99.3 | 9.0 | 10.9 | 7.9 | 305 | No |
| 13 | 7 | 950 | 25 | 54.0 | 59.8 | 59.1 | 63.2 | 94.6 | 91.8 | 94.2 | 12.4 | 13.5 | 10.2 | 275 | No |
| 14 | 8 | 1000 | 190 | 0 | 38.6 | 35.2 | 37.1 | 54.6 | 52.6 | 53.8 | 22.4 | 28.8 | 26.5 | 161 | Yes |
| 15 | 9 | 950 | 25 | 100 | 109.5 | 107.5 | 108.1 | 146.9 | 143.2 | 149.2 | 3.0 | 1.5 | 0.8 | 472 | No |
| 16 | 1 | 750 | 25 | 0 | 33.4 | 31.3 | 32.2 | 51.6 | 50.1 | 52.4 | 28.2 | 31.4 | 28.4 | 145 | Yes |
| 17 | 1 | 980 | 0.03 | 0 | 33.6 | 31.7 | 32.0 | 51.7 | 50.7 | 51.1 | 27.6 | 30.4 | 28.1 | 142 | Yes |
| 18 | 1 | — | — | 0 | 86.8 | 91.6 | 99.4 | 89.5 | 96.3 | 104.6 | 2.4 | 1.8 | 0.7 | 270 | Yes |

Note:
(1)Example
(2)Steel
(3)L; longitudinal, D; diagonal, T; traneverse

EXAMPLE 19–30

These examples illustrate commercial production of low Cr 2CR materials according to the invention, using a continuous heat treatment furnace.

Steels having chemical compositions indicated in Table 9 were cast, hot rolled to a thickness of 3.6 mm, annealed at a temperature of 780° C. for 6 hours in a furnace, allowed to cool in the same furnace, pickled and cold rolled to a thickness of 0.3 mm under the conditions of cold rolling and intermediate annealing indicated in Table 10. Each cold rolled strip was continuously finish heat treated with a time of uniform heateng of 1 minute in a continuous heat treatment furnace under conditions indicated in Table 10, except for in Examples 29 and 30. In Example 29 the cold rolled strip was heated in a box furnace with a time of uniform heating of about 6 hours and allowed to cool in the same furnace. In Example 30, a hot rolled strip of Steel 10 of a thickness of 3.6 mm was annealed, pickled, cold rolled, air cooled and temper rolled to a thickness of 0.3 mm under conditions indicated in Table 10. The time of uniform heating in the intermediate annealing step was 1 minute in all Examples. Specimens of the products were tested for 0.2% proof stress, tensile strength and elongation in directions of 0° (longitudinal), 45° (diagonal) and 90° (transverse) to the direction of rolling, and for amount of martensite and hardness. On broken specimens from the tensile test, yes or no of ridging occurrence was observed. The results are shown in Table 10.

Examples 19–25 are in accordance with the invention, whereas Examples 26–30 are controls.

As seen from Table 10, steel strips of a duplex structure containing from about 65 to about 75% by volume of martensite having a combination of great strength and harness as well as good elongation were obtained by processes of Example 19–25 according to the invention. The products of the invention exhibited reduced plane anisotropy in respect to 0.2% proof stress, tensile strength and elongation.

In contrast, Steel 17 used in Example 26 had an {Ni+(Mn+Cu)/3} content as low as 0.19%, and in consequence, no martensite was formed by the continuous finish heat treatment. The product of Example 14 had poor strength and hardness.

Steel 18 used in Example 27 had an unduly high C content of 0.31% and as relatively high Ni content of 3.20% inspite of its low Cr content, and in consequence, resulted in 100% martensite having a combination of great strength and hardness with poor elongation.

At the heating temperature of the continuous finish heat treatment (780° C.) used in Example 28, Steel 10 employed did not form a two-phase of ferrite and austenite. Accordingly, the product after the finish heat treatment had a single phase structure of ferrite, exhibiting a combination of high elongation with poor strength and hardness.

In Example 29, the cold rolled strip of Steel 10 was heated in a box furnace and allowed to cool in the same furnace at an insufficient cooling rate of 0.03° C./sec for transformation of austenite to martensite. Accordingly, the product after the heat treatment contained no martensite transformed, exhibiting a combination of high elongation with poor strength and hardness, as was the case in Example 28.

The product of Example 30 was a temper rolled material which had, when compared with the products of the invention, remarkably low elongation, high yield ratio (a ratio of 0.2% proof to tensile strength) and prominent plane anisotropy in respect to 0.2% proof stress, tensile strength and elongation. Apparently, such a product is inferior to the products of the invention regarding workability or formability and shape precision after worked or formed.

Table 10 further reveals that broken specimens from the tensile test of Examples 26, 28, 29 and 30 showed occurrence of ridging. In contrast the products of the invention were completely free from the problem of ridging. This means that the products of the invention work well in press-forming.

TABLE 9

| | (in % by weight) | | | | | | | | | | | |
|---|---|---|---|---|---|---|---|---|---|---|---|---|
| Steel | C | Si | Mn | P | S | Ni | Cr | N | Al | O | Cu | Others |
| 10 | 0.025 | 0.31 | 0.16 | 0.015 | 0.005 | 0.70 | 13.21 | 0.017 | <0.005 | 0.012 | 0.06 | |
| 11 | 0.011 | 0.53 | 2.07 | 0.016 | 0.006 | 0.15 | 12.32 | 0.011 | 0.032 | 0.007 | 0.04 | |
| 12 | 0.068 | 0.55 | 0.25 | 0.016 | 0.006 | 0.12 | 12.65 | 0.026 | 0.142 | 0.005 | 0.95 | |
| 13 | 0.028 | 1.53 | 0.57 | 0.015 | 0.006 | 1.12 | 12.51 | 0.011 | 0.027 | 0.007 | 0.10 | |

TABLE 9-continued

| Steel | C | Si | Mn | P | S | Ni | Cr | N | Al | O | Cu | Others |
|---|---|---|---|---|---|---|---|---|---|---|---|---|
| | (in % by weight) | | | | | | | | | | | |
| 14 | 0.012 | 0.48 | 0.55 | 0.016 | 0.006 | 0.52 | 12.30 | 0.011 | 0.015 | 0.010 | 0.05 | B 0.0021 |
| 15 | 0.034 | 0.30 | 0.72 | 0.015 | 0.005 | 0.73 | 13.07 | 0.009 | 0.020 | 0.008 | 0.05 | Mo 0.60 |
| 16 | 0.013 | 0.35 | 0.61 | 0.015 | 0.002 | 1.68 | 13.51 | 0.009 | 0.051 | 0.007 | 0.04 | REM 0.029, Y 0.025 |
| 17 | 0.008 | 0.53 | 0.21 | 0.015 | 0.006 | 0.10 | 13.50 | 0.007 | <0.005 | 0.011 | 0.05 | |
| 18 | 0.310 | 0.41 | 0.57 | 0.015 | 0.005 | 3.20 | 12.58 | 0.008 | <0.005 | 0.009 | 0.05 | |

TABLE 10

| Ex (1) | St (2) | Conditions of cold rolling and annealing (3) | Finish heat treatment temperature °C. | Finish heat treatment rate of cooling °C./sec | Properties (4) Amount of martensite (% by vol) | Properties (4) 0.2% proof (kgf/mm²) | | |
|---|---|---|---|---|---|---|---|---|
| | | | | | | | D | T |
| 19 | 10 | $3.6^t \rightarrow$ CR $\rightarrow 1.0^t \rightarrow$ An720° C. $\rightarrow$ CR $\rightarrow 0.3^t$ mm | 980 | 98 | 70.0 | 63.9 | 62.5 | 64.3 |
| 20 | 11 | $3.6^t \rightarrow$ CR $\rightarrow 1.0^t \rightarrow$ An720° C. $\rightarrow$ CR $\rightarrow 0.3^t$ mm | 1000 | 200 | 66.5 | 50.4 | 52.3 | 52.7 |
| 21 | 12 | $3.6^t \rightarrow$ CR $\rightarrow 1.8^t \rightarrow$ An730° C. $\rightarrow$ CR $\rightarrow 0.9^t \rightarrow$ An730° C. $\rightarrow$ CR $\rightarrow 0.3^t$ mm | 1050 | 70 | 69.5 | 57.8 | 59.5 | 58.2 |
| 22 | 13 | $3.6^t \rightarrow$ CR $\rightarrow 1.0^t \rightarrow$ An730° C. $\rightarrow$ CR $\rightarrow 0.3^t$ mm | 1050 | 150 | 65.0 | 64.2 | 57.6 | 62.1 |
| 23 | 14 | $3.6^t \rightarrow$ CR $\rightarrow 1.8^t \rightarrow$ An730° C. $\rightarrow$ CR $\rightarrow 0.9^t \rightarrow$ An730° C. $\rightarrow$ CR $\rightarrow 0.3^t$ mm | 1100 | 55 | 64.6 | 42.5 | 44.1 | 43.4 |
| 24 | 15 | $3.6^t \rightarrow$ CR $\rightarrow 1.0^t \rightarrow$ An720° C. $\rightarrow$ CR $\rightarrow 0.3^t$ mm | 950 | 95 | 72.7 | 64.2 | 58.6 | 62.4 |
| 25 | 16 | $3.6^t \rightarrow$ CR $\rightarrow 1.0^t \rightarrow$ An720° C. $\rightarrow$ CR $\rightarrow 0.3^t$ mm | 900 | 95 | 74.7 | 64.8 | 59.3 | 62.7 |
| 26 | 17 | $3.6^t \rightarrow$ CR $\rightarrow 1.0^t \rightarrow$ An720° C. $\rightarrow$ CR $\rightarrow 0.3^t$ mm | 930 | 150 | 0 | 29.2 | 30.4 | 29.2 |
| 27 | 18 | $3.6^t \rightarrow$ CR $\rightarrow 1.0^t \rightarrow$ An720° C. $\rightarrow$ CR $\rightarrow 0.3^t$ mm | 980 | 53 | 100 | 134.2 | 131.6 | 127.4 |
| 28 | 10 | $3.6^t \rightarrow$ CR $\rightarrow 1.0^t \rightarrow$ An720° C. $\rightarrow$ CR $\rightarrow 0.3^t$ mm | 780 | 25 | 0 | 31.4 | 33.3 | 32.1 |
| 29 | 10 | $3.6^t \rightarrow$ CR $\rightarrow 1.0^t \rightarrow$ An720° C. $\rightarrow$ CR $\rightarrow 0.3^t$ mm | 980 | 0.03 | 0 | 31.7 | 33.5 | 31.8 |
| 30 | 10 | $3.6^t \rightarrow$ CR $\rightarrow 1.2^t \rightarrow$ An720° C. $\rightarrow$ CR $\rightarrow 0.3^t$ mm | — | — | 0 | 86.7 | 91.5 | 98.6 |

| Ex (1) | St (2) | Properties (4) Tensile strength (kgf/mm²) L | D | T | Elongation (%) L | D | T | Hardness Hv | ridging |
|---|---|---|---|---|---|---|---|---|---|
| 19 | 10 | 92.8 | 92.5 | 92.8 | 11.2 | 11.2 | 10.4 | 279 | No |
| 20 | 11 | 84.9 | 87.0 | 86.4 | 13.8 | 12.3 | 15.1 | 250 | No |
| 21 | 12 | 91.6 | 94.3 | 93.9 | 13.5 | 12.7 | 11.6 | 270 | No |
| 22 | 13 | 95.9 | 98.2 | 101.1 | 10.7 | 8.9 | 9.1 | 300 | No |
| 23 | 14 | 82.6 | 85.1 | 82.9 | 16.5 | 13.0 | 14.6 | 241 | No |
| 24 | 15 | 95.7 | 98.0 | 99.3 | 10.9 | 9.1 | 9.2 | 302 | No |
| 25 | 16 | 96.2 | 97.8 | 99.8 | 10.6 | 9.3 | 9.1 | 307 | No |
| 26 | 17 | 47.6 | 48.7 | 47.2 | 30.6 | 28.1 | 30.2 | 141 | Yes |
| 27 | 18 | 167.2 | 163.1 | 157.4 | 5.1 | 4.8 | 5.3 | 560 | No |
| 28 | 10 | 50.1 | 51.5 | 50.2 | 31.1 | 28.2 | 31.7 | 140 | Yes |
| 29 | 10 | 52.3 | 51.8 | 50.6 | 30.4 | 27.8 | 30.6 | 143 | Yes |
| 30 | 10 | 89.4 | 96.2 | 100.8 | 2.4 | 1.7 | 0.6 | 268 | Yes |

Note
(1) Example
(2) Steel
(3) t; thickness(mm), CR; cold rolling, An; annealing
(4) L; longitadinal, D; diagonal, T; transverse

EXAMPLE 31–42

These examples illustrate commercial production of high Cr 2CR materials according to the invention, using a continuous heat treatment furnace.

Steels having chemical compositions indicated in Table 11 were cast, hot rolled to a thickness of 3.6 mm, annealed at a temperature of 780° C. for 6 hours in a furnace, allowed to cool in the same furnace, pickled and cold rolled to a thickness of 0.3 mm under the conditions of cold rolling and intermediate annealing indicated in Table 12. Each cold rolled strip was continuously finish heat treated with a time of uniform heateng of 1 minute in a continuous heat treatment furnace under conditions indicated in Table 12, except for in Examples 41 and 42. In Example 41 the cold rolled strip was heated in a box furnace with a time of uniform heating of about 6 hours and allowed to cool in the same furnace. In Example 42, a hot rolled strip of Steel 19 of a thickness of 3.6 mm was annealed, pickled, cold rolled, air cooled and temper rolled to a thickness of 0.3 mm under conditions indicated in Table 12. The time of uniform heating in the intermediate annealing step was 1 minute in all Examples. Specimens of the products were tested for 0.2% proof stress, tensile strength and elongation in directions of 0° (longitudinal), 45° (diagonal) and 90° (transverse) to the direction of rolling, and for amount of martensite and hardness. On broken specimens from the tensile test, yes or no of ridging occurrence was observed. The results are shown in Table 12.

Examples 31–37 are in accordance with the invention, whereas Examples 38–42 are controls.

As seen from Table 12, steel strips of a duplex structure containing from about 30 to about 60% by volume of martensite having a combination of great strength and harness as well as good elongation were obtained by processes of Examples 31–37 according to the invention. The products of the invention exhibited reduced plane anisotropy in respect of 0.2% proof stress, tensile strength and elongation.

In contrast, Steel 26 used in Example 38 had a {Ni+(Mn+Cu)/3} content as low as 0.24%, and in consequence, no martensite was formed by the continuous finish heat treatment. The product of Example 38 had poor strength and hardness.

Steel 27 used in Example 39 had an unduly high C content of 0.405% and an unduly high Ni content of 5.07%, and in consequence, resulted in 100% martensite, having a combination of great strength with poor elongation.

At the heating temperature of the continuous finish heat treatment (750° C.) used in Example 40, Steel 19 employed did not form a two-phase of ferrite and austenite. Accordingly, the product after the finish heat treatment had a single phase structure of ferrite, exhibiting a combination of high elongation with poor strength and hardness.

In Example 41 the cold rolled strip of Steep 19 was heated in a box furnace and allowed to cool in the same furnace at an insufficient cooling rate of 0.03° C./sec for transformation of austenite to martensite. Accordingly, the product after the heat treatment contained no martensite transformed, exhibiting a combination of high elongation with poor strength and hardness.

The product of Example 42 was a temper rolled material which had, when compared with the products of the invention, remarkably low elongation, high yield ratio (a ratio of 0.2% proof to tensile strength) and prominent plane anisotropy in respect of 0.2% proof stress, tensile strength and elongation. Apparently, such a product is inferior to the products of the invention regarding workability or formability and shape precision after worked or formed.

Table 12 further reveals that broken specimens from the tensile test of Examples 38, 40, 41 and 42 showed occurrence of riding. In contrast the products of the invention were completely free from the problem of riding. This means that the products of the invention work well in press-forming.

TABLE 11

| | (in % by weight) | | | | | | | | | | | |
|---|---|---|---|---|---|---|---|---|---|---|---|---|
| Steel | C | Si | Mn | P | S | Ni | Cr | N | Al | O | Cu | Others |
| 19 | 0.045 | 0.41 | 0.30 | 0.018 | 0.006 | 1.05 | 16.20 | 0.014 | 0.005 | 0.014 | 0.04 | |
| 20 | 0.021 | 0.55 | 0.85 | 0.019 | 0.006 | 2.61 | 16.63 | 0.009 | 0.150 | 0.005 | 0.04 | |
| 21 | 0.089 | 0.42 | 0.35 | 0.019 | 0.005 | 0.22 | 16.85 | 0.072 | 0.162 | 0.006 | 0.77 | |
| 22 | 0.055 | 1.55 | 0.30 | 0.018 | 0.008 | 1.02 | 16.15 | 0.022 | 0.005 | 0.008 | 0.06 | |
| 23 | 0.073 | 0.41 | 0.45 | 0.018 | 0.006 | 0.53 | 16.41 | 0.025 | 0.011 | 0.008 | 0.05 | B 0.0021 |
| 24 | 0.045 | 0.43 | 0.37 | 0.019 | 0.010 | 1.53 | 15.60 | 0.023 | 0.005 | 0.019 | 0.05 | Mo 0.51 |
| 25 | 0.043 | 0.42 | 2.21 | 0.019 | 0.001 | 1.15 | 18.15 | 0.018 | <0.005 | 0.011 | 0.05 | REM 0.029, Y 0.035 |
| 26 | 0.011 | 0.49 | 0.41 | 0.018 | 0.005 | 0.09 | 18.56 | 0.006 | 0.029 | 0.007 | 0.05 | |
| 27 | 0.405 | 0.45 | 0.31 | 0.018 | 0.005 | 5.07 | 17.45 | 0.014 | <0.005 | 0.010 | 0.05 | |

TABLE 12

| | | | Finish heat treatment | | Properties (4) | | | |
|---|---|---|---|---|---|---|---|---|
| Ex (1) | St (2) | Conditions of cold rolling and annealing (3) | temperature °C. | rate of cooling °C./sec | Amount of martensite (% by vol) | 0.2% proof (kgf/mm²) L | D | T |
| 31 | 19 | $3.6^t \rightarrow$ CR $\rightarrow 1.0^t \rightarrow$ An720° C. $\rightarrow$ CR $\rightarrow 0.3^t$ mm | 1000 | 12 | 50.0 | 50.5 | 52.3 | 52.7 |
| 32 | 20 | $3.6^t \rightarrow$ CR $\rightarrow 1.0^t \rightarrow$ An730° C. $\rightarrow$ CR $\rightarrow 0.3^t$ mm | 1050 | 25 | 45.5 | 42.2 | 43.8 | 43.1 |
| 33 | 21 | $3.6^t \rightarrow$ CR $\rightarrow 1.8^t \rightarrow$ An720° C. $\rightarrow$ CR $\rightarrow 0.9^t \rightarrow$ An720° C. $\rightarrow$ CR $\rightarrow 0.3^t$ mm | 980 | 15 | 51.3 | 62.0 | 61.8 | 60.2 |
| 34 | 22 | $3.6^t \rightarrow$ CR $\rightarrow 1.0^t \rightarrow$ An730° C. $\rightarrow$ CR $\rightarrow 0.3^t$ mm | 1000 | 150 | 32.7 | 49.0 | 51.8 | 51.2 |
| 35 | 23 | $3.6^t \rightarrow$ CR $\rightarrow 1.8^t \rightarrow$ An720° C. $\rightarrow$ CR $\rightarrow 0.9^t \rightarrow$ An720° C. $\rightarrow$ CR $\rightarrow 0.3^t$ mm | 980 | 25 | 53.9 | 62.3 | 62.5 | 60.9 |
| 36 | 24 | $3.6^t \rightarrow$ CR $\rightarrow 1.0^t \rightarrow$ An720° C. $\rightarrow$ CR $\rightarrow 0.3^t$ mm | 880 | 190 | 57.8 | 72.1 | 69.1 | 70.3 |
| 37 | 25 | $3.6^t \rightarrow$ CR $\rightarrow 1.0^t \rightarrow$ An720° C. $\rightarrow$ CR $\rightarrow 0.3^t$ mm | 950 | 25 | 54.1 | 58.1 | 59.8 | 58.5 |
| 38 | 26 | $3.6^t \rightarrow$ CR $\rightarrow 1.0^t \rightarrow$ An750° C. $\rightarrow$ CR $\rightarrow 0.3^t$ mm | 1000 | 190 | 0 | 35.3 | 38.6 | 37.2 |
| 39 | 27 | $3.6^t \rightarrow$ CR $\rightarrow 1.0^t \rightarrow$ An720° C. $\rightarrow$ CR $\rightarrow 0.3^t$ mm | 950 | 25 | 100 | 109.0 | 107.8 | 105.2 |
| 40 | 19 | $3.6^t \rightarrow$ CR $\rightarrow 1.0^t \rightarrow$ An720° C. $\rightarrow$ CR $\rightarrow 0.3^t$ mm | 750 | 25 | 0 | 37.2 | 39.8 | 38.5 |
| 41 | 19 | $3.6^t \rightarrow$ CR $\rightarrow 1.0^t \rightarrow$ An720° C. $\rightarrow$ CR $\rightarrow 0.3^t$ mm | 1000 | 0.03 | 0 | 35.9 | 39.1 | 38.6 |
| 42 | 19 | $3.6^t \rightarrow$ CR $\rightarrow 1.2^t \rightarrow$ An720° C. $\rightarrow$ CR $\rightarrow 0.3^t$ mm | — | — | 0 | 86.9 | 91.7 | 97.4 |

| | | Properties | | | | | | | |
|---|---|---|---|---|---|---|---|---|---|
| Ex | St | Tensile strength (kgf/mm²) | | | Elongation (%) | | | Hardness | |
| (1) | (2) | L | D | T | L | D | T | Hv | ridging |
| 31 | 19 | 84.9 | 87.0 | 86.4 | 13.7 | 12.2 | 15.7 | 253 | No |
| 32 | 20 | 82.3 | 84.8 | 82.6 | 16.4 | 12.9 | 14.5 | 237 | No |
| 33 | 21 | 92.4 | 93.1 | 92.8 | 10.6 | 12.1 | 10.4 | 291 | No |
| 34 | 22 | 83.4 | 85.5 | 84.9 | 13.1 | 12.3 | 13.9 | 259 | No |
| 35 | 23 | 92.9 | 93.7 | 93.1 | 10.3 | 11.5 | 9.9 | 295 | No |
| 36 | 24 | 102.3 | 99.4 | 100.5 | 7.5 | 9.1 | 7.2 | 322 | No |
| 37 | 25 | 91.9 | 94.6 | 94.2 | 13.4 | 12.6 | 11.5 | 275 | No |
| 38 | 26 | 52.7 | 54.5 | 53.5 | 27.3 | 22.3 | 28.3 | 161 | Yes |
| 39 | 27 | 146.1 | 146.3 | 148.7 | 2.9 | 1.7 | 1.0 | 472 | No |
| 40 | 19 | 55.1 | 56.3 | 55.2 | 27.5 | 21.1 | 27.9 | 165 | Yes |
| 41 | 19 | 53.2 | 55.0 | 54.0 | 25.1 | 23.8 | 22.5 | 159 | Yes |
| 42 | 19 | 90.1 | 96.1 | 101.2 | 2.3 | 1.6 | 0.6 | 270 | Yes |

Note
(1) Example
(2) Steel
(3) t; thickness(mm), CR; cold rolling, An; annealing
(4) L; longitadinal, D; diagonal, T; transverse

EXAMPLES 43–48

These Examples illustrate effect of Mo on properties of 0.05C-1.5Ni-16.5Cr 1CR and 2CR materials. Examples 43–45 relate to 1CR materials, while Examples 46–48 relates to 2CR materials.

In Examples 43–45, Steels having chemical compositions indicated in Table 13 were cast, hot rolled to a thickness of 3.6 mm, annealed at a temperature of 780° C. for 6 hours in a furnace, allowed to cool in the same furnace, pickled, cold rolled to a thickness of 0.7 mm (a reduction rate of 80.6%) in a single step of cold rolling with no intermediate annealing, heated to a temperature of 950° for about 1 minute and cooled to ambient temperature at an average cooling rate of about 100° C./sec.

In Examples 46–48, Steels having chemical compositions indicated in Table 13 were cast, hot rolled to a thickness of 3.6 mm, annealed at a temperature of 780° C. for 6 hours in a furnace, allowed to cool in the same furnace, pickled, cold rolled to a thickness of 1.0 mm, annealed at a temperature of 720° C. for about 1 minute, air cooled, cold rolled to a final thickness of 0.3 mm, heated to a temperature of 950° C. for about 1 minute and cooled to ambient temperature at an average cooling rate of about 100° C./sec.

Specimens of the products were tested for 0.2% proof stress, tensile strength and elongation in directions of 0° (longitudinal), 45° (diagonal) and 90° (transverse) to the direction of rolling, and for amount of martensite and hardness. On broken specimens from the tensile test, yes or no of ridging occurrence was observed. The results are shown in Table 14.

Table 14 reveals that the higher the Mo content the lower the the amount of martensite. This is because Mo is a ferrite former.

TABLE 13

| | (in % by weight) | | | | | | | | | | | |
|---|---|---|---|---|---|---|---|---|---|---|---|---|
| Steel | C | Si | Mn | P | S | Ni | Cr | N | Al | O | Cu | Mo |
| 28 | 0.052 | 0.49 | 0.30 | 0.020 | 0.002 | 1.55 | 16.43 | 0.011 | 0.010 | 0.004 | 0.04 | — |
| 29 | 0.049 | 0.55 | 0.27 | 0.020 | 0.001 | 1.47 | 16.45 | 0.015 | 0.007 | 0.006 | 0.08 | 0.95 |
| 30 | 0.056 | 0.53 | 0.31 | 0.018 | 0.002 | 1.51 | 16.40 | 0.012 | 0.008 | 0.006 | 0.09 | 2.11 |

TABLE 14

| | | Properties (3) | | | | | | | | | | | | |
|---|---|---|---|---|---|---|---|---|---|---|---|---|---|---|
| Ex | St | Amount of martensite | 0.2% proof (kgf/mm²) | | | Tensile strength (kgf/mm²) | | | Elongation (%) | | | Hardness | |
| (1) | (2) | (% by vol) | L | D | T | L | D | T | L | D | T | Hv | ridging |
| 43 | 28 | 61.9 | 65.3 | 63.1 | 64.6 | 105.4 | 102.2 | 104.3 | 11.5 | 10.8 | 8.0 | 325 | No |
| 44 | 29 | 52.4 | 54.7 | 52.0 | 55.4 | 90.2 | 88.5 | 89.7 | 14.7 | 12.9 | 9.2 | 270 | No |
| 45 | 30 | 42.0 | 45.8 | 44.3 | 47.2 | 84.6 | 82.1 | 84.4 | 15.4 | 16.0 | 10.7 | 253 | No |
| 46 | 28 | 63.2 | 64.7 | 65.4 | 65.0 | 103.9 | 105.1 | 104.0 | 11.0 | 10.2 | 10.8 | 321 | No |
| 47 | 29 | 51.7 | 53.2 | 55.1 | 54.0 | 89.7 | 91.0 | 89.5 | 14.8 | 14.0 | 15.1 | 275 | No |
| 48 | 30 | 44.3 | 44.5 | 46.1 | 44.9 | 83.2 | 85.0 | 83.8 | 16.1 | 14.9 | 15.9 | 250 | No |

Note
(1) Example
(2) Steel
(3) L; longitudinal, D; diagonal, T; traneverse

Specimens of the products of Examples 46–48 were tested for pit corrosion potential $V_{c'200}$ in an aqueous solution containing 1000 ppm of chlorine ion at a temperature of 40° C. The $V_{c'200}$ is a potential vs SCE in volt when a current of 200 microampere begins to flow. The results are shown in Table 15. Table 15 reveals that the higher the Mo content the higher the $V_{c'200}$, indicating that addition of Mo is effective for enhancing corrosion resistance.

TABLE 15

| Steel | Mo (%) | Pit corrosion resistance (VvsSCE) |
|---|---|---|
| 31 | tr | 0.28 |
| 32 | 0.95 | 0.35 |
| 33 | 2.11 | 0.45 |

What is claimed is:

1. A process for the production of a strip of a chromium stainless steel of a duplex structure, consisting essentially of ferrite and martensite, having high strength and elongation as well as reduced plane anisotropy and having a hardness of at least HV 200, which process comprises:

a step of hot rolling a slab of a steel to provide a hot rolled strip, said steel comprising, by weight from 10.0% to 20.0% of Cr, up to 0.10% of C, up to 0.12% of N, the (C+N) being not less than 0.01% but not more than 0.20%, up to 2.0% of Si, up to 4.0% of Mn, up to 4.0% of Ni and up to 4.0% of Cu, the {Ni+(Mn+Cu)/3} being not less than 0.5% but not more than 5.0%, the balance being Fe and unavoidable impurities;

a step of cold rolling the hot rolled strip to provide a cold rolled strip of a desired thickness; and a step of continuous final heat treatment in which the cold rolled strip is continuously passed through a heating zone where it is heated to a temperature ranging from the Ac1 point of the steel to 1100° C. to form a two-phase of ferrite and austenite and maintained at that temperature for not longer than 10 minutes, and the heated strip is cooled at a cooling rate sufficient to transform the austenite to martensite.

2. The process in accordance with claim 1 wherein in said continuous heat treatment step the cold rolled strip is heated to a temperature ranging from at least 100° C. above the Ac1 point of the steel to 1100° C. to form a two-phase of ferrite and austenite.

3. The process in accordance with claim 1 wherein in said continuous heat treatment step the cold rolled strip is heated to a temperature ranging from 850° C. to 1100° C. to form a two-phase of ferrite and austenite.

4. The process in accordance with claim 1 wherein in said steel employed consists essentially of, by weight,:

up to 0.08% of C,
up to 2.0% of Si,
up to 3.0% of Mn,
up to 0.040% of P,
up to 0.030% of S,
up to 3.0% of Ni,
from 10.0% to 14.0% of Cr,

US004824491B1

REEXAMINATION CERTIFICATE (2900th)

United States Patent [19]

[11] B1 4,824,491

Tanaka et al.

[45] Certificate Issued * Jun. 4, 1996

[54] PROCESS FOR THE PRODUCTION OF A STRIP OF A CHROMIUM STAINLESS STEEL OF A DUPLEX STRUCTURE HAVING HIGH STRENGTH AND ELONGATION AS WELL AS REDUCED PLANE ANISOTROPY

[75] Inventors: Teruo Tanaka; Katsuhisa Miyakusu; Hiroshi Fujimoto, all of Yamaguchi, Japan

[73] Assignee: Nisshin Steel Co., Ltd., Tokyo, Japan

Reexamination Request:
No. 90/003,606, Oct. 17, 1994

Reexamination Certificate for:

| | |
|---|---|
| Patent No.: | **4,824,491** |
| Issued: | **Apr. 25, 1989** |
| Appl. No.: | **134,873** |
| Filed: | **Dec. 18, 1987** |

[ * ] Notice: The portion of the term of this patent subsequent to Mar. 14, 2006, has been disclaimed.

[30] Foreign Application Priority Data

| | | | |
|---|---|---|---|
| Dec. 30, 1986 | [JP] | Japan | 61-311961 |
| Dec. 30, 1986 | [JP] | Japan | 61-311962 |
| Jan. 3, 1987 | [JP] | Japan | 62-101 |

[51] Int. Cl.[6] ..... C26D 8/02

[52] U.S. Cl. ..... 148/597; 148/610

[58] Field of Search ..... 148/599, 597, 148/610, 605

[56] References Cited

U.S. PATENT DOCUMENTS

| | | |
|---|---|---|
| 2,145,171 | 1/1939 | Giles . |
| 3,309,238 | 3/1967 | Randak et al. . |
| 3,650,848 | 3/1972 | Schneider et al. . |
| 3,674,467 | 7/1972 | Chalk . |
| 3,861,909 | 1/1975 | Caton . |
| 3,989,514 | 11/1976 | Fujioka et al. . |
| 4,049,430 | 9/1977 | Myers . |
| 4,141,762 | 2/1979 | Yamaguchi et al. . |
| 4,564,392 | 1/1986 | Ohhashi et al. . |

FOREIGN PATENT DOCUMENTS

| | | |
|---|---|---|
| 1951908 | 8/1971 | Germany . |
| 2023657 | 6/1979 | United Kingdom . |

OTHER PUBLICATIONS

*The Making, Shaping and Treating of Steel* (10th ed. 1985), pp. 1100, 1264, 1335, 1338.

Peckner and Bernstein, *Handbook of Stainless Steels* (McGraw-Hill 1977) pp. 14–22.

Fig. IV-2 of *Stainless Steel Fabrication* (Allegheny Ludlum Corp. 1959), p. 132.

"Effects of Alloying Elements And Heat Treatment On Microstructures And Mechanical Properties Of Ferrite-Martensite Dual Phase Stainless Steel Sheets" by Miyakusu et al. (of Nisshin Steel Co., Ltd.) *Proceedings of International Conference on Stainless Steels*, 1991, Chiba, ISIJ.

"Anisotropy in Metals", Chalmers, *Process in Metal Physics 2* (Interscience publishers 1950), p. 115.

"Anisotropy in Polycrystalline Materials", Honeycombe, *The Plastic Deformation of Metals* (2d ed., Edward Arnold/American Society for Metals 1984), pp. 326–327.

*Primary Examiner*—Deborah Yee

[57] ABSTRACT

Process for producing steel strip of duplex structure wherein cold rolled strip of chromium stainless steel comprising, in addition to Fe, 10.0% to 20.0% of Cr, to 0.10% C, to 0.12% of N, the (C+N) being 0.01% to 0.20%, to 2.0% of Si, to 4.0% of Mn to 4.0% of Ni and to 4.0% of Cu, the {Ni+(Mn+Cu)/3} being not less that 0.5% but not more than 5.0%, is continuously passed through a heating zone where it is heated to form a two-phase of ferrite and austenite and the heated strip is cooled at a cooling rate sufficient to transform the austenite to martensite. The product has high strength and elongation reduced plane amisotropy and hardness of at least HV 200.

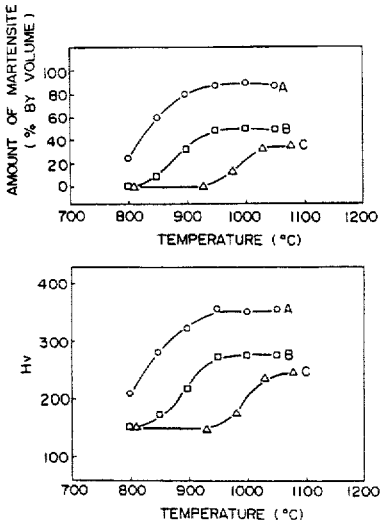

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, lines 52 to 68:

Mn, Ni and Cu are austenite formers and are useful for the control of the amount of martensite and the strength of the product. These elements make it possible to reduce the amount of C needed thereby to enhance elongation of the product by formation of relatively soft martensite and to prevent deterioration of [corrossion] *corrosion* resistance of the product by suppression of precipitation of Cr carbide in grain boundaries. Further, it appears that addition of these elements renders the Ac1 point of the steel lower, whereby the working temperature in the continuous finish heat treatment step of the process [accordning] *according* to the invention may be lowered. The lower the working temperature, the more advantageous from [view points] *the viewpoint* of both saving energy and strength of the material being continuously processed. To enjoy these effects we have found that at least 0.5% of {Ni+(Mn+Cu)/3} is required. On the Column 6, lines 1 to 19:

other hand, excessively [hith] *high* amount of these elements should be avoided, or otherwise the amount of martensite eventually formed increases, often to 100%, rendering the elongation of the product poor. The upper limits for Mn, Ni and [Couf] *Cu* are now set, in the cases of low Cr steels, as 3.0%, preferably 1.0% for Mn, 3.0% for Ni, 3.0% for Cu and 3.0% for {Ni+(Mn+Cu)/3}, respectively, and in the cases of high Cr steels, as 4.0% preferably 1.0% for [mn] *Mn*, 4.0% for Ni, 4.0% for Cu and 5.0% for {Ni+(Mn+Cu)/3}, respectively. However, different from Ni and Cu, Mn may adversely [affects] *affect* oxidation resistance of the steel, whereby a lot of scale may be formed during the continuous heat treatment, leading to increase of the burden of pickling and/or deterioration of surface textures of the product. Further, Mn may adversely affect corrosion resistance of the product. For these reasons Mn is preferably controlled at a level of 1.0% or less, as is the case with conventional ferritic and martensitic steels.

Column 8, lines 17 to 23:

The hot rolled strip, preferably after annealed and descaled, is [col] *cold* rolled to a desired thickness, which can be as thin as from about 0.1 mm to about 1.0 mm in cases wherein the product of the invention is intended to be used as a material for the fabrication of parts of electronic instruments and precision machines by press-forming.

Table 8, bridging columns 17 and 18:

TABLE 8

| | | Finish heat treatment | | Properties(3) |
|---|---|---|---|---|
| Ex(1) | St(2) | temperature °C. | rate of cooling °C./sec | Amount of martensite (% by vol) |
| 7 | 1 | 980 | 100 | 71.5 |
| 8 | 2 | 1050 | 25 | 45.8 |
| 9 | 3 | 1000 | 15 | 51.5 |
| 10 | 4 | 1050 | 150 | 35.6 |
| 11 | 5 | 980 | 25 | 53.9 |
| 12 | 6 | 880 | 95 | 72.5 |
| 13 | 7 | 950 | 25 | 54.0 |
| 14 | 8 | 1000 | 190 | 0 |
| 15 | 9 | 950 | 25 | 100 |
| 16 | 1 | 750 | 25 | 0 |
| 17 | 1 | 980 | 0.03 | 0 |
| 18 | 1 | — | — | 0 |

| | Properties(3) | | | | | |
|---|---|---|---|---|---|---|
| | 0.2% proof (kgf/mm²) | | | Tensile strength (kgf/mm²) | | |
| Ex(1) | L | D | T | L | D | T |
| 7 | 64.1 | 62.2 | 65.7 | 93.8 | 92.1 | 94.5 |
| 8 | 45.1 | 43.8 | 43.3 | 84.2 | 82.1 | 83.1 |
| 9 | 62.2 | 61.1 | 61.8 | 92.7 | 91.7 | 94.8 |
| 10 | 50.1 | 48.8 | 48.3 | 88.2 | 86.1 | 88.0 |
| 11 | 62.8 | 61.7 | 62.4 | 94.1 | 92.2 | 95.1 |
| 12 | 64.2 | 58.8 | 62.1 | 98.1 | 95.2 | 99.3 |
| 13 | 59.8 | 59.1 | 63.2 | 94.6 | 91.8 | 94.2 |
| 14 | 38.6 | 35.2 | 37.1 | 54.6 | 52.6 | 53.8 |
| 15 | 109.5 | 107.5 | 108.1 | 146.9 | 143.2 | 149.2 |
| 16 | 33.4 | 31.3 | 32.2 | 51.6 | 50.1 | 52.4 |
| 17 | 33.6 | 31.7 | 32.0 | 51.7 | 50.7 | 51.1 |
| 18 | 86.8 | 91.6 | 99.4 | 89.5 | 96.3 | 104.6 |

| | Properties(3) | | | | |
|---|---|---|---|---|---|
| | Elongation (%) | | | Hardness | |
| Ex(1) | L | D | T | Hv | ridging |
| 7 | 11.0 | 11.7 | 9.1 | 280 | No |
| 8 | *12.9* [2.9] | 16.1 | 13.1 | 237 | No |
| 9 | 10.4 | 12.3 | 9.1 | 291 | No |
| 10 | 12.4 | 15.6 | 12.0 | 256 | No |
| 11 | 10.3 | 11.6 | 8.7 | 295 | No |
| 12 | 9.0 | 10.9 | 7.9 | 305 | No |
| 13 | 12.4 | 13.5 | 10.2 | 275 | No |
| 14 | 22.4 | 28.8 | 26.5 | 161 | Yes |
| 15 | 3.0 | 1.5 | 0.8 | 472 | No |
| 16 | 28.2 | 31.4 | 28.4 | 145 | Yes |
| 17 | 27.6 | 30.4 | 28.1 | 142 | Yes |
| 18 | 2.4 | 1.8 | 0.7 | 270 | Yes |

Note:
(1)Example
(2)Steel
(3)L; logitudinal, D; diagonal, T; transverse

Table 15, column 23, lines 62 to 67:

TABLE 15

| Steel | Mo (%) | Pit corrosion resistance (VvsSCE) |
|---|---|---|
| *Ex. 46* [31] | tr | 0.28 |
| *Ex. 47* [32] | 0.95 | 0.35 |

TABLE 15-continued

| Steel | Mo (%) | Pit corrosion resistance (VvsSCE) |
|---|---|---|
| *Ex. 48* [33] | 2.11 | 0.45 |

AS A RESULT OF REEXAMINATION, IT HAS BEEN DETERMINED THAT:

Claims 1 to 13 are cancelled.

New claims 14 to 18 are added and determined to be patentable.

*14. A process for the production of a strip of a chromium stainless steel of a duplex structure, consisting essentially of ferrite and martensitee, having high strength and elongation as well as reduced plane anisotropy and having a hardness of at least HV 200, which process comprises:* a step of hot rolling a slab of a steel to provide a hot rolled strip, said steel comprising, by weight, from 10.0% *to 20.0% of Cr, up to 0.10% of C, up to 0.12% of N, the (C+N) being not less than 0.01% but not more than 0.20%, up to 2.0% of Si, up to 1.0% of Mn, up to 4.0% of Ni and 4.0% of Cu, the {Ni+(Mn+Cu)/3} being not less than 0.5% but not more than 5.0% the balance being Fe and unavoidable impurities;*

*a step of cold rolling the hot rolled strip to provide a cold rolling strip of a desired thickness; and*

*a step of continuous finish heat treatment in which the cold rolled strip is continuously passed through a heating zone where it is heated to a temperature ranging from at least 100° C. above the Ac1 point of the steel to 1100° C. to form a two-phase of ferrite and austenite and maintained at that temperatur for not longer than 10 minutes, and the heated strip is cooled at a cooling rate sufficient to transform the austenite to martensite.*

*15. The process in accordance with claim 14 wherein said steel employed consists essentially of, by weight:*

*up to 0.08% of C,*

*up to 2.0% of Si,*

*up to 1.0% of Mn,*

*up to 0.040% of P,*

*up to 0.030% of S,*

*up to 3.0% of Ni,*

*from 10.0% to 14.0% of Cr,*

*up to 0.08% of N, the (C+N) being not less than 0.01% but not more than 0.12%,*

*up to 0.02% of O,*

*up to 3.0% of Cu, the {Ni+(Mn+Cu)/3} being not less than 0.5% but not more than 3.0%,*

*up to 0.20% of Al,*

*up to 0.0050% of B,*

*up to 2.5% of Mo,*

*up to 0.10% of REM, and*

*up to 0.20% of Y, the balance being Fe and unavoidable impurities.*

*16. The process in accordance with claim 14 wherein said steel employed consists essentially of, by weight:*

*up to 0.10% of C,*

*up to 2.0% of Si,*

*up to 1.0% of Mn,*

*up to 0.040% of P,*

*up to 0.030% of S,*

*up to 4.0% of Ni,*

*more than 14.0% to 20.0% of Cr,*

*up to 0.12% of N, the (C+N) being not less than 0.01% but not more than 0.20%,*

*up to 0.02% of O,*

*up to 4.0% of Cu, the {Ni+(Mn+Cu)/3} being not less than 0.5% but not more than 5.0%,*

*up to 0.20% of Al;*

*up to 0.0050% of B,*

*up to 2.5% of Mo,*

*up to 0.10% of REM, and*

*up to 0.20% of Y, the balance being Fe and unavoidable impurities.*

*17. A process for the production of a strip of a chromium stainless steel of a duplex structure, consisting essentially of ferrite and martensite, having high strength and elongation as well as reduced plane anisotropy and having a hardness of at least HV 200, which process comprises:*

*a step of hot rolling a slab of a steel to provide a hot rolled strip, said steel consisting essentially of, by weight:*

*up to 0.08% of C,*

*up to 2.0% of Si,*

*up to 1.0% of Mn,*

*up to 0.040% of P,*

*up to 0.030% of S,*

*up to 3.0% of Ni,*

*from 10.0% to 14.0% of Cr,*

*up to 0.08% of N, the (C+N) being not less than 0.01% but not more than 0.12%,*

*up to 0.02% of O,*

*up to 3.0% of Cu, the {Ni+(Mn+Cu)/3} being not less than 0.5% but not more than 3.0%;*

*up to 0.20% of Al,*

*up to 0.0050% of B,*

*up to 2.5% of Mo,*

*up to 0.10% of REM, and*

*up to 0.20% of Y, the balance Fe and unavoidable impurities;*

*at least two steps of cold rolling the hot rolled strip to provide a cold rolled strip of a desired thickness, including a step of intermediate annealing between the successive two cold rolling steps, said intermediate annealing comprising heating and maintaining the strip at a temperature to form a single phase of ferrite; and*

*a step of continuous finish heat treatment in which the cold rolled strip is continuously passed through a heating zone where it is heated to a temperature ranging from at least 100° C. above the Ac1 point of the steel to 1100° C. to form a two-phase of ferrite and austenite and maintained at that temperature for not longer than 10 minutes, and the heated strip is cooled at a cooling rate sufficient to transform the austenite to martensite.*

*18. A process for the production of a strip of a chromium stainless steel of a duplex structure, consisting essentially of ferritee and martensit, having high strength and elongation*

*as well as reduced plane anisotropy and having a hardness of at least HV 200, which process comprises:*

*a step of hot rolling a slab of a steel to provide a hot rolled strip, said steel consisting essentially of, by weight:*

*up to 0.10% of C,*

*up to 2.0% of Si,*

*up to 1.0% of Mn,*

*up to 0.040% of P,*

*up to 0.030% of S,*

*up to 4.0% of Ni,*

*more than 14.0% to 20.0% of Cr,*

*up to 0.12%* of N, the*(C+N) being not less than 0.01% but not more than 0.20%,*

*up to 0.02% of O,*

*up to 4.0% of Cu, the {Ni+(Mn+Cu)/3} being not less than 0.5% but not more than 5.0%;*

*up to 0.20% of Al,*

*up to 0.0050% of B,*

*up to 2.5% of Mo,*

*up to 0.10% of REM, and*

*up to 0.20% of Y, the balance being Fe and unavoidable impurities;*

*at least two steps of cold rolling the hot rolled strip to provide a cold rolled strip of a desired thickness, including a step of intermediate annealing between the successive two cold rolling steps, said intermediate annealing comprising heating and maintaining the strip at a temperature to form a single phase of ferrite; and*

*a step of continuous finish heat treatment in which the cold rolled strip is continuously passed through a heating zone where it is heated to a temperature ranging from at least 100° C. above the Ac1 point of the steel to 1100° C. to form a two-phase of ferrite and austenite and maintained at that temperature for not longer than 10 minutes, and the heated strip is cooled at a cooling rate sufficient to transform the austenite to martensite.*

* * * * *

US004824491B1

REEXAMINATION CERTIFICATE (2900th)

United States Patent [19]

Tanaka et al.

[11] B1 4,824,491

[45] Certificate Issued * Jun. 4, 1996

[54] PROCESS FOR THE PRODUCTION OF A STRIP OF A CHROMIUM STAINLESS STEEL OF A DUPLEX STRUCTURE HAVING HIGH STRENGTH AND ELONGATION AS WELL AS REDUCED PLANE ANISOTROPY

[75] Inventors: Teruo Tanaka; Katsuhisa Miyakusu; Hiroshi Fujimoto, all of Yamaguchi, Japan

[73] Assignee: Nisshin Steel Co., Ltd., Tokyo, Japan

Reexamination Request:
No. 90/003,606, Oct. 17, 1994

Reexamination Certificate for:

| | |
|---|---|
| Patent No.: | **4,824,491** |
| Issued: | **Apr. 25, 1989** |
| Appl. No.: | **134,873** |
| Filed: | **Dec. 18, 1987** |

[ * ] Notice: The portion of the term of this patent subsequent to Mar. 14, 2006, has been disclaimed.

[30] Foreign Application Priority Data

| | | | |
|---|---|---|---|
| Dec. 30, 1986 | [JP] | Japan | 61-311961 |
| Dec. 30, 1986 | [JP] | Japan | 61-311962 |
| Jan. 3, 1987 | [JP] | Japan | 62-101 |

[51] Int. Cl.[6] ..... C26D 8/02

[52] U.S. Cl. ..... 148/597; 148/610

[58] Field of Search ..... 148/599, 597, 148/610, 605

[56] References Cited

U.S. PATENT DOCUMENTS

| | | |
|---|---|---|
| 2,145,171 | 1/1939 | Giles . |
| 3,309,238 | 3/1967 | Randak et al. . |
| 3,650,848 | 3/1972 | Schneider et al. . |
| 3,674,467 | 7/1972 | Chalk . |
| 3,861,909 | 1/1975 | Caton . |
| 3,989,514 | 11/1976 | Fujioka et al. . |
| 4,049,430 | 9/1977 | Myers . |
| 4,141,762 | 2/1979 | Yamaguchi et al. . |
| 4,564,392 | 1/1986 | Ohhashi et al. . |

FOREIGN PATENT DOCUMENTS

| | | |
|---|---|---|
| 1951908 | 8/1971 | Germany . |
| 2023657 | 6/1979 | United Kingdom . |

OTHER PUBLICATIONS

*The Making, Shaping and Treating of Steel* (10th ed. 1985), pp. 1100, 1264, 1335, 1338.

Peckner and Bernstein, *Handbook of Stainless Steels* (McGraw-Hill 1977) pp. 14–22.

Fig. IV-2 of *Stainless Steel Fabrication* (Allegheny Ludlum Corp. 1959), p. 132.

"Effects of Alloying Elements And Heat Treatment On Microstructures And Mechanical Properties Of Ferrite-Martensite Dual Phase Stainless Steel Sheets" by Miyakusu et al. (of Nisshin Steel Co., Ltd.) *Proceedings of International Conference on Stainless Steels,* 1991, Chiba, ISIJ.

"Anisotropy in Metals", Chalmers, *Process in Metal Physics* 2 (Interscience publishers 1950), p. 115.

"Anisotropy in Polycrystalline Materials", Honeycombe, *The Plastic Deformation of Metals* (2d ed., Edward Arnold/ American Society for Metals 1984), pp. 326–327.

*Primary Examiner*—Deborah Yee

[57] ABSTRACT

Process for producing steel strip of duplex structure wherein cold rolled strip of chromium stainless steel comprising, in addition to Fe, 10.0% to 20.0% of Cr, to 0.10% C, to 0.12% of N, the (C+N) being 0.01% to 0.20%, to 2.0% of Si, to 4.0% of Mn to 4.0% of Ni and to 4.0% of Cu, the {Ni+(Mn+Cu)/3} being not less that 0.5% but not more than 5.0%, is continuously passed through a heating zone where it is heated to form a two-phase of ferrite and austenite and the heated strip is cooled at a cooling rate sufficient to transform the austenite to martensite. The product has high strength and elongation reduced plane amisotropy and hardness of at least HV 200.

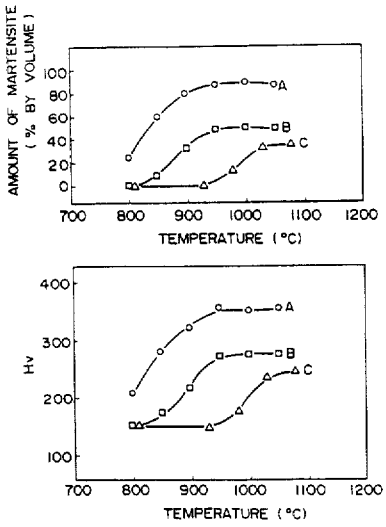

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, lines 52 to 68:

Mn, Ni and Cu are austenite formers and are useful for the control of the amount of martensite and the strength of the product. These elements make it possible to reduce the amount of C needed thereby to enhance elongation of the product by formation of relatively soft martensite and to prevent deterioration of [corrossion] *corrosion* resistance of the product by suppression of precipitation of Cr carbide in grain boundaries. Further, it appears that addition of these elements renders the Ac1 point of the steel lower, whereby the working temperature in the continuous finish heat treatment step of the process [accordning] *according* to the invention may be lowered. The lower the working temperature, the more advantageous from [view points] *the viewpoint* of both saving energy and strength of the material being continuously processed. To enjoy these effects we have found that at least 0.5% of {Ni+(Mn+Cu)/3} is required. On the Column 6, lines 1 to 19:

other hand, excessively [hith] *high* amount of these elements should be avoided, or otherwise the amount of martensite eventually formed increases, often to 100%, rendering the elongation of the product poor. The upper limits for Mn, Ni and [Couf] *Cu* are now set, in the cases of low Cr steels, as 3.0%, preferably 1.0% for Mn, 3.0% for Ni, 3.0% for Cu and 3.0% for {Ni+(Mn+Cu)/3}, respectively, and in the cases of high Cr steels, as 4.0% preferably 1.0% for [mn] *Mn*, 4.0% for Ni, 4.0% for Cu and 5.0% for {Ni+(Mn+Cu)/3}, respectively. However, different from Ni and Cu, Mn may adversely [affects] *affect* oxidation resistance of the steel, whereby a lot of scale may be formed during the continuous heat treatment, leading to increase of the burden of pickling and/or deterioration of surface textures of the product. Further, Mn may adversely affect corrosion resistance of the product. For these reasons Mn is preferably controlled at a level of 1.0% or less, as is the case with conventional ferritic and martensitic steels.

Column 8, lines 17 to 23:

The hot rolled strip, preferably after annealed and descaled, is [col] *cold* rolled to a desired thickness, which can be as thin as from about 0.1 mm to about 1.0 mm in cases wherein the product of the invention is intended to be used as a material for the fabrication of parts of electronic instruments and precision machines by press-forming.

Table 8, bridging columns 17 and 18:

TABLE 8

| | | Finish heat treatment | | Properties(3) |
|---|---|---|---|---|
| Ex(1) | St(2) | temperature °C. | rate of cooling °C./sec | Amount of martensite (% by vol) |
| 7 | 1 | 980 | 100 | 71.5 |
| 8 | 2 | 1050 | 25 | 45.8 |
| 9 | 3 | 1000 | 15 | 51.5 |
| 10 | 4 | 1050 | 150 | 35.6 |
| 11 | 5 | 980 | 25 | 53.9 |
| 12 | 6 | 880 | 95 | 72.5 |
| 13 | 7 | 950 | 25 | 54.0 |
| 14 | 8 | 1000 | 190 | 0 |
| 15 | 9 | 950 | 25 | 100 |
| 16 | 1 | 750 | 25 | 0 |
| 17 | 1 | 980 | 0.03 | 0 |
| 18 | 1 | — | — | 0 |

| | Properties(3) | | | | | |
|---|---|---|---|---|---|---|
| | 0.2% proof (kgf/mm²) | | | Tensile strength (kgf/mm²) | | |
| Ex(1) | L | D | T | L | D | T |
| 7 | 64.1 | 62.2 | 65.7 | 93.8 | 92.1 | 94.5 |
| 8 | 45.1 | 43.8 | 43.3 | 84.2 | 82.1 | 83.1 |
| 9 | 62.2 | 61.1 | 61.8 | 92.7 | 91.7 | 94.8 |
| 10 | 50.1 | 48.8 | 48.3 | 88.2 | 86.1 | 88.0 |
| 11 | 62.8 | 61.7 | 62.4 | 94.1 | 92.2 | 95.1 |
| 12 | 64.2 | 58.8 | 62.1 | 98.1 | 95.2 | 99.3 |
| 13 | 59.8 | 59.1 | 63.2 | 94.6 | 91.8 | 94.2 |
| 14 | 38.6 | 35.2 | 37.1 | 54.6 | 52.6 | 53.8 |
| 15 | 109.5 | 107.5 | 108.1 | 146.9 | 143.2 | 149.2 |
| 16 | 33.4 | 31.3 | 32.2 | 51.6 | 50.1 | 52.4 |
| 17 | 33.6 | 31.7 | 32.0 | 51.7 | 50.7 | 51.1 |
| 18 | 86.8 | 91.6 | 99.4 | 89.5 | 96.3 | 104.6 |

| | Properties(3) | | | | |
|---|---|---|---|---|---|
| | Elongation (%) | | | Hardness | |
| Ex(1) | L | D | T | Hv | ridging |
| 7 | 11.0 | 11.7 | 9.1 | 280 | No |
| 8 | *12.9* [2.9] | 16.1 | 13.1 | 237 | No |
| 9 | 10.4 | 12.3 | 9.1 | 291 | No |
| 10 | 12.4 | 15.6 | 12.0 | 256 | No |
| 11 | 10.3 | 11.6 | 8.7 | 295 | No |
| 12 | 9.0 | 10.9 | 7.9 | 305 | No |
| 13 | 12.4 | 13.5 | 10.2 | 275 | No |
| 14 | 22.4 | 28.8 | 26.5 | 161 | Yes |
| 15 | 3.0 | 1.5 | 0.8 | 472 | No |
| 16 | 28.2 | 31.4 | 28.4 | 145 | Yes |
| 17 | 27.6 | 30.4 | 28.1 | 142 | Yes |
| 18 | 2.4 | 1.8 | 0.7 | 270 | Yes |

Note:
(1)Example
(2)Steel
(3)L; logitudinal, D; diagonal, T; transverse

Table 15, column 23, lines 62 to 67:

TABLE 15

| Steel | Mo (%) | Pit corrosion resistance (VvsSCE) |
|---|---|---|
| *Ex. 46* [31] | tr | 0.28 |
| *Ex. 47* [32] | 0.95 | 0.35 |

TABLE 15-continued

| Steel | Mo (%) | Pit corrosion resistance (VvsSCE) |
|---|---|---|
| *Ex. 48* [33] | 2.11 | 0.45 |

AS A RESULT OF REEXAMINATION, IT HAS BEEN DETERMINED THAT:

Claims 1 to 13 are cancelled.

New claims 14 to 18 are added and determined to be patentable.

*14. A process for the production of a strip of a chromium stainless steel of a duplex structure, consisting essentially of ferrite and martensitee, having high strength and elongation as well as reduced plane anisotropy and having a hardness of at least HV 200, which process comprises:* a step of hot rolling a slab of a steel to provide a hot rolled strip, said steel comprising, by weight, from 10.0% *to 20.0% of Cr, up to 0.10% of C, up to 0.12% of N, the (C+N) being not less than 0.01% but not more than 0.20%, up to 2.0% of Si, up to 1.0% of Mn, up to 4.0% of Ni and 4.0% of Cu, the {Ni+(Mn+Cu)/3} being not less than 0.5% but not more than 5.0% the balance being Fe and unavoidable impurities;*

*a step of cold rolling the hot rolled strip to provide a cold rolling strip of a desired thickness; and*

*a step of continuous finish heat treatment in which the cold rolled strip is continuously passed through a heating zone where it is heated to a temperature ranging from at least 100° C. above the Ac1 point of the steel to 1100° C. to form a two-phase of ferrite and austenite and maintained at that temperatur for not longer than 10 minutes, and the heated strip is cooled at a cooling rate sufficient to transform the austenite to martensite.*

*15. The process in accordance with claim 14 wherein said steel employed consists essentially of, by weight:*

*up to 0.08% of C,*

*up to 2.0% of Si,*

*up to 1.0% of Mn,*

*up to 0.040% of P,*

*up to 0.030% of S,*

*up to 3.0% of Ni,*

*from 10.0% to 14.0% of Cr,*

*up to 0.08% of N, the (C+N) being not less than 0.01% but not more than 0.12%,*

*up to 0.02% of O,*

*up to 3.0% of Cu, the {Ni+(Mn+Cu)/3} being not less than 0.5% but not more than 3.0%,*

*up to 0.20% of Al,*

*up to 0.0050% of B,*

*up to 2.5% of Mo,*

*up to 0.10% of REM, and*

*up to 0.20% of Y, the balance being Fe and unavoidable impurities.*

*16. The process in accordance with claim 14 wherein said steel employed consists essentially of, by weight:*

*up to 0.10% of C,*

*up to 2.0% of Si,*

*up to 1.0% of Mn,*

*up to 0.040% of P,*

*up to 0.030% of S,*

*up to 4.0% of Ni,*

*more than 14.0% to 20.0% of Cr,*

*up to 0.12% of N, the (C+N) being not less than 0.01% but not more than 0.20%,*

*up to 0.02% of O,*

*up to 4.0% of Cu, the {Ni+(Mn+Cu)/3} being not less than 0.5% but not more than 5.0%,*

*up to 0.20% of Al;*

*up to 0.0050% of B,*

*up to 2.5% of Mo,*

*up to 0.10% of REM, and*

*up to 0.20% of Y, the balance being Fe and unavoidable impurities.*

*17. A process for the production of a strip of a chromium stainless steel of a duplex structure, consisting essentially of ferrite and martensite, having high strength and elongation as well as reduced plane anisotropy and having a hardness of at least HV 200, which process comprises:*

*a step of hot rolling a slab of a steel to provide a hot rolled strip, said steel consisting essentially of, by weight:*

*up to 0.08% of C,*

*up to 2.0% of Si,*

*up to 1.0% of Mn,*

*up to 0.040% of P,*

*up to 0.030% of S,*

*up to 3.0% of Ni,*

*from 10.0% to 14.0% of Cr,*

*up to 0.08% of N, the (C+N) being not less than 0.01% but not more than 0.12%,*

*up to 0.02% of O,*

*up to 3.0% of Cu, the {Ni+(Mn+Cu)/3} being not less than 0.5% but not more than 3.0%;*

*up to 0.20% of Al,*

*up to 0.0050% of B,*

*up to 2.5% of Mo,*

*up to 0.10% of REM, and*

*up to 0.20% of Y, the balance Fe and unavoidable impurities;*

*at least two steps of cold rolling the hot rolled strip to provide a cold rolled strip of a desired thickness, including a step of intermediate annealing between the successive two cold rolling steps, said intermediate annealing comprising heating and maintaining the strip at a temperature to form a single phase of ferrite; and*

*a step of continuous finish heat treatment in which the cold rolled strip is continuously passed through a heating zone where it is heated to a temperature ranging from at least 100° C. above the Ac1 point of the steel to 1100° C. to form a two-phase of ferrite and austenite and maintained at that temperature for not longer than 10 minutes, and the heated strip is cooled at a cooling rate sufficient to transform the austenite to martensite.*

*18. A process for the production of a strip of a chromium stainless steel of a duplex structure, consisting essentially of ferritee and martensit, having high strength and elongation*

*as well as reduced plane anisotropy and having a hardness of at least HV 200, which process comprises:*

*a step of hot rolling a slab of a steel to provide a hot rolled strip, said steel consisting essentially of, by weight:*

*up to 0.10% of C,*

*up to 2.0% of Si,*

*up to 1.0% of Mn,*

*up to 0.040% of P,*

*up to 0.030% of S,*

*up to 4.0% of Ni,*

*more than 14.0% to 20.0% of Cr,*

*up to 0.12%* of N, the*(C+N) being not less than 0.01% but not more than 0.20%,*

*up to 0.02% of O,*

*up to 4.0% of Cu, the {Ni+(Mn+Cu)/3} being not less than 0.5% but not more than 5.0%;*

*up to 0.20% of Al,*

*up to 0.0050% of B,*

*up to 2.5% of Mo,*

*up to 0.10% of REM, and*

*up to 0.20% of Y, the balance being Fe and unavoidable impurities;*

*at least two steps of cold rolling the hot rolled strip to provide a cold rolled strip of a desired thickness, including a step of intermediate annealing between the successive two cold rolling steps, said intermediate annealing comprising heating and maintaining the strip at a temperature to form a single phase of ferrite; and*

*a step of continuous finish heat treatment in which the cold rolled strip is continuously passed through a heating zone where it is heated to a temperature ranging from at least 100° C. above the Ac1 point of the steel to 1100° C. to form a two-phase of ferrite and austenite and maintained at that temperature for not longer than 10 minutes, and the heated strip is cooled at a cooling rate sufficient to transform the austenite to martensite.*

* * * * *